US007798913B2

(12) United States Patent
Noble et al.

(10) Patent No.: US 7,798,913 B2
(45) **Date of Patent: *Sep. 21, 2010**

(54) GOLF CLUBS WITH VARIABLE MOMENT OF INERTIA AND METHODS OF MANUFACTURE THEREOF

(75) Inventors: Randall B. Noble, Phoenix, AZ (US); Jeff A. Blankenship, Phoenix, AZ (US); Eric V. Cole, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 50 days.

This patent is subject to a terminal disclaimer.

(21) Appl. No.: 12/183,941

(22) Filed: Jul. 31, 2008

(65) Prior Publication Data

US 2010/0029409 A1 Feb. 4, 2010

(51) Int. Cl.
*A63B 53/04* (2006.01)

(52) U.S. Cl. ..... 473/324; 473/332; 473/333; 473/334; 473/335; 473/345; 473/346; 473/349; 473/350; 473/329

(58) Field of Classification Search ..... 473/324–350, 473/287–292, 409
See application file for complete search history.

(56) References Cited

U.S. PATENT DOCUMENTS

| | | | | |
|---|---|---|---|---|
| 1,320,163 | A * | 10/1919 | Maurice | 473/335 |
| 2,171,383 | A | 8/1939 | Wettlaufer | |
| 2,652,256 | A | 9/1953 | Thomas | |
| 3,589,731 | A | 6/1971 | Chancellor, Jr. | |
| 4,123,056 | A | 10/1978 | Nakamatsu | |
| 4,602,787 | A * | 7/1986 | Sugioka et al. | 473/338 |
| 4,895,371 | A * | 1/1990 | Bushner | 473/336 |
| 5,000,454 | A | 3/1991 | Soda | |
| 5,297,794 | A * | 3/1994 | Lu | 473/337 |
| 5,911,637 | A | 6/1999 | Yamagata | |
| 6,077,173 | A * | 6/2000 | Stites | 473/334 |
| 6,206,789 | B1 * | 3/2001 | Takeda | 473/335 |
| 6,299,549 | B1 * | 10/2001 | Shieh | 473/342 |
| 6,309,311 | B1 * | 10/2001 | Lu | 473/332 |
| 6,386,987 | B1 | 5/2002 | Lejeune, Jr. | |
| 6,852,038 | B2 | 2/2005 | Yabu | |
| 6,918,840 | B2 | 7/2005 | Stites et al. | |
| 7,056,228 | B2 * | 6/2006 | Beach et al. | 473/345 |
| 7,070,514 | B1 * | 7/2006 | Borunda | 473/333 |
| 7,201,669 | B2 * | 4/2007 | Stites et al. | 473/337 |
| 7,247,104 | B2 | 7/2007 | Poynor | |
| 7,303,489 | B2 * | 12/2007 | Gilbert et al. | 473/350 |
| 7,404,772 | B2 * | 7/2008 | Koide et al. | 473/334 |
| 2007/0135230 | A1 * | 6/2007 | Consiglio | 473/332 |

* cited by examiner

*Primary Examiner*—Sebastiano Passaniti

(57) ABSTRACT

In one embodiment, a golf club head includes a body and a restrictor mechanism coupled to a first portion of the body. The restrictor mechanism can have a base coupled to the first portion of the body, and a weight coupled to the base. The restrictor mechanism can be configured to (1) present a first resistance to a first deformation of the base in response to a rotational inertia of the weight relative to a rotation of the golf club head in a first direction, and (2) present a second resistance to a second deformation of the base in response to the rotational inertia of the weight relative to a rotation of the golf club head in a second direction opposite the first direction, where the first resistance is greater than the second resistance. Other examples and related methods are disclosed herein.

38 Claims, 20 Drawing Sheets

11000

13000

Fig. 19
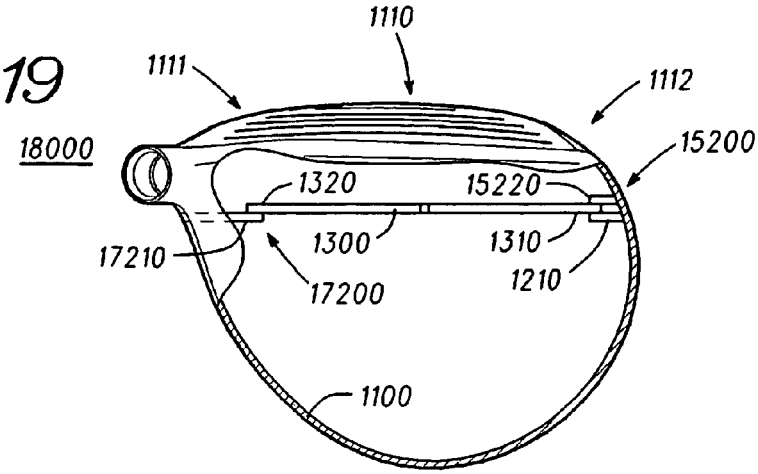
Fig. 20
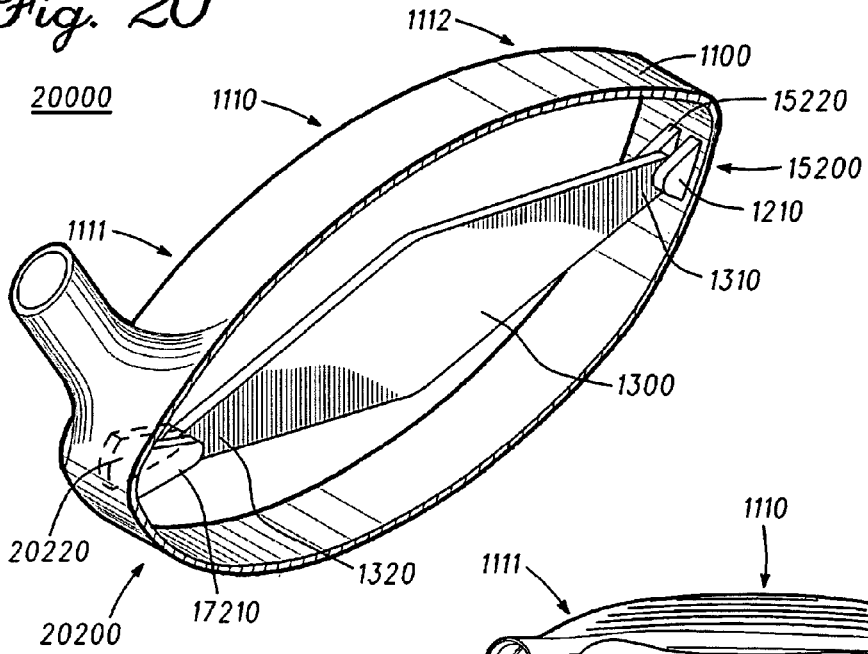
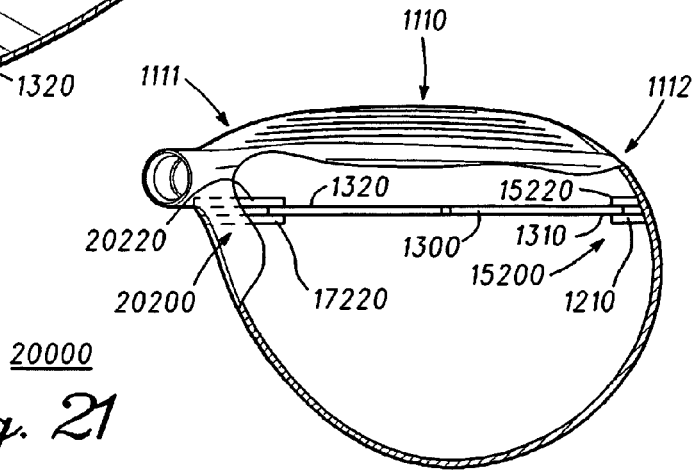
Fig. 21

28000

29200

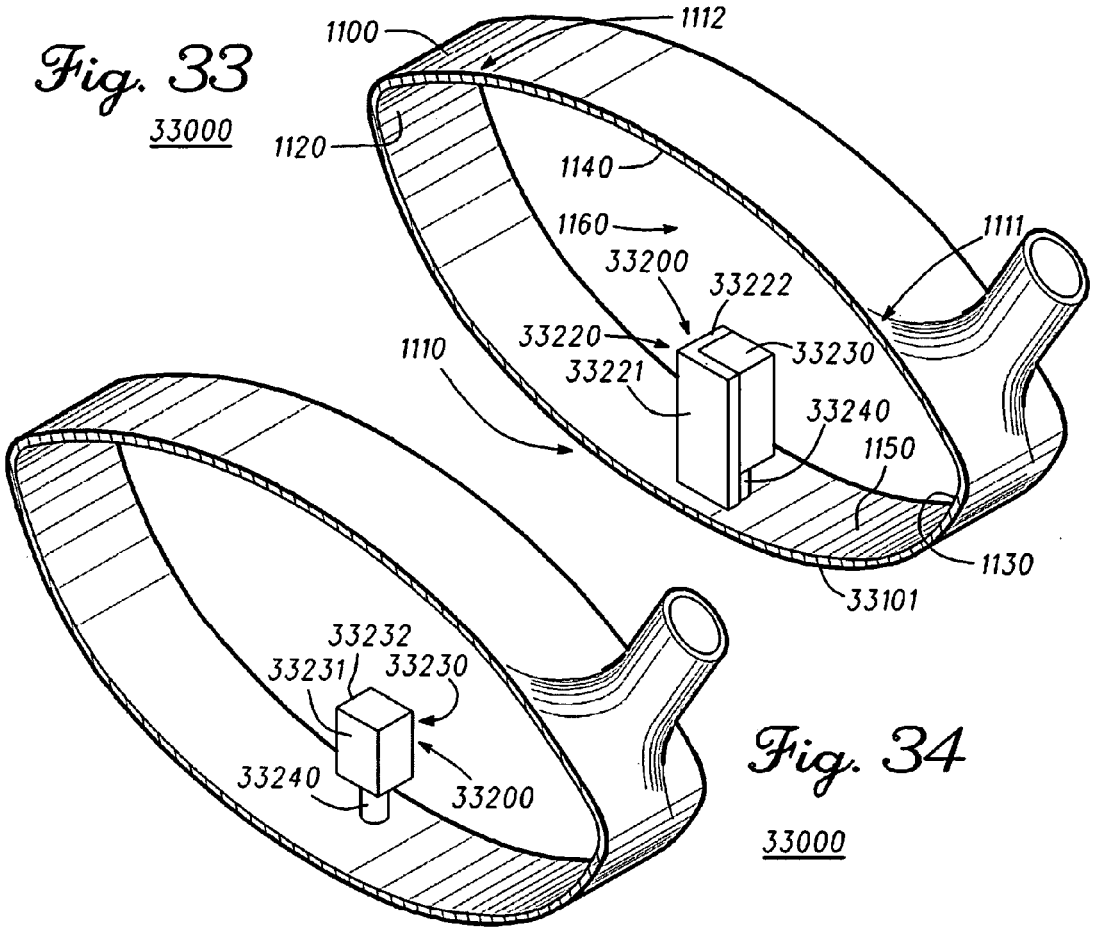
Fig. 33
Fig. 34
33000
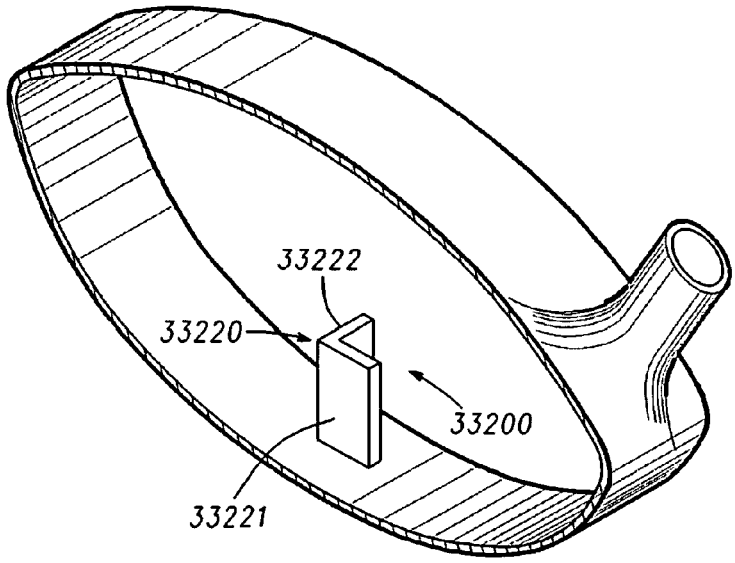
33000
Fig. 35

33000

33000

33000

41000

42000

43000

44000

45000

48000

GOLF CLUBS WITH VARIABLE MOMENT OF INERTIA AND METHODS OF MANUFACTURE THEREOF

TECHNICAL FIELD

This disclosure relates generally to golf equipment, and relates more particularly to golf clubs with variable moments of inertia and methods of manufacture thereof.

BACKGROUND

Some individuals who play golf may have a tendency to hit a golf ball with a hook or draw, or a slide or fade. These unintended trajectories can be the result of hitting the golf ball outside a central region of the golf club face. Hitting the golf ball outside this region can rotate the golf club head, which can cause an unintended spin on the golf ball, and this spin can exacerbate an individual's tendency to hook/draw or slide/fade the golf ball. Therefore, a need exists to minimize the club head rotation when an individual hits a golf ball outside the central region of the golf club face.

BRIEF DESCRIPTION OF THE DRAWINGS

FIG. 19 illustrates a top cross-sectional view of part of the golf club head of FIG. 18.

FIG. 20 illustrates a perspective cross-sectional view of part of a golf club head comprising two dual-restrictor mechanisms.

FIG. 21 illustrates a top cross-sectional view of part of the golf club head of FIG. 20.

FIG. 33 illustrates a perspective cross-sectional view of part of a golf club head comprising another restrictor mechanism.

FIG. 34 illustrates a perspective cross-sectional view of part of the golf club head of FIG. 33, focusing on a weight.

FIG. 35 illustrates a perspective cross-sectional view of part of the golf club head of FIG. 33, focusing on a tab set.

Figure 1:
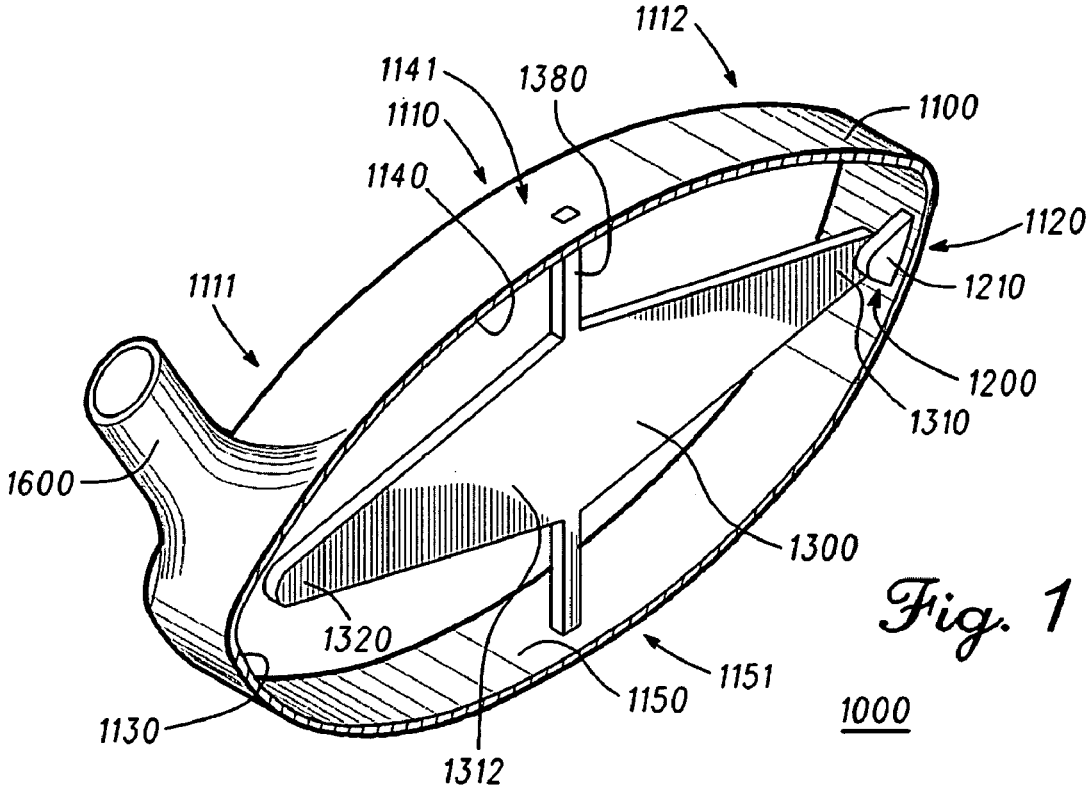
FIG. 1 illustrates a perspective cross-sectional view of part of a golf club head.

For simplicity and clarity of illustration, the drawing figures illustrate the general manner of construction, and descriptions and details of well-known features and techniques may be omitted to avoid unnecessarily obscuring of the drawings. Additionally, elements in the drawing figures are not necessarily drawn to scale. For example, the dimensions of some of the elements in the figures may be exaggerated relative to other elements to help improve understanding of different embodiments. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the golf club attachment mechanism and related methods described herein are, for example, capable of operation in sequences other than those illustrated or otherwise described herein. Furthermore, the terms "include," and "have," and any variations thereof, are intended to cover a non-exclusive inclusion, such that a process, method, system, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the golf club attachment mechanism and related methods described herein are, for example, capable of operation in other orientations than those illustrated or otherwise described herein. The term "coupled," as used herein, is defined as directly or indirectly connected in an electrical, physical, mechanical, or other manner. The term "on," as used herein, is defined as on, at, or otherwise adjacent to or next to or over.

The terms "couple," "coupled," "couples," "coupling," and the like should be broadly understood and refer to connecting two or more elements or signals, electrically and/or mechanically, either directly or indirectly through intervening circuitry and/or elements. Two or more electrical elements may be electrically coupled, either direct or indirectly, but not be mechanically coupled; two or more mechanical elements may be mechanically coupled, either direct or indirectly, but not be electrically coupled; two or more electrical elements may be mechanically coupled, directly or indirectly, but not be electrically coupled. Coupling (whether only mechanical, only electrical, or both) may be for any length of time, e.g., permanent or semi-permanent or only for an instant.

The absence of the word "removably," "removable," and the like near the word "coupled," and the like does not mean that the coupling, etc. in question is or is not removable.

DESCRIPTION

In one embodiment, a golf club head comprises a body having a front section, a first restrictor mechanism comprising a first restrictor and coupled to a first portion of the body, and a weight coupled to the body and comprising a first end coupled to the first restrictor mechanism. The first restrictor comprises a first stiffness, and the first stiffness is configured to resist a deformation of the first restrictor by the first end of the weight in response to an impact at a first zone of the front section.

In a second embodiment, a golf club head comprises a body, a restrictor mechanism coupled to the body, the restrictor mechanism comprising: a first tab of one or more tabs, a weight comprising a first side adjacent to the first tab, and a deformable portion coupled to at least one of the first tab or the weight. The restrictor mechanism is configured to permit a deformation of the deformable portion, responsive to an inertia of the weight, in response to an impact at a first zone of the body, and resist the deformation of the deformable portion, via the first tab, in response to an impact at a second zone of the body.

In a third embodiment, a golf club head, comprises a body, and a restrictor mechanism coupled to a first portion of the body. The restrictor mechanism comprises a base coupled to the first portion of the body, and a weight coupled to the base. The restrictor mechanism is configured to permit a deformation of the base in response to an inertia of the weight relative to a rotation of the golf club head in a first direction, and resist the deformation of the base in response to an inertia of the weight relative to a rotation of the golf club head in a second direction. Other examples, embodiments, and related methods are further described below.

Figure 2:
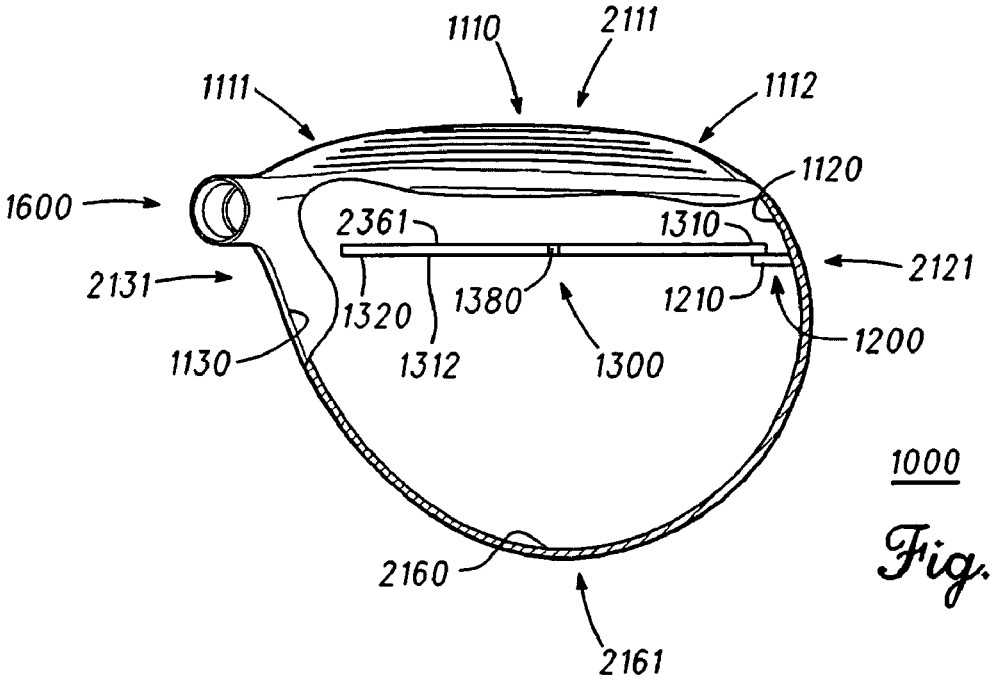
FIG. 2 illustrates a top cross-sectional view of part of the golf club head of FIG. 1.
Figure 3:
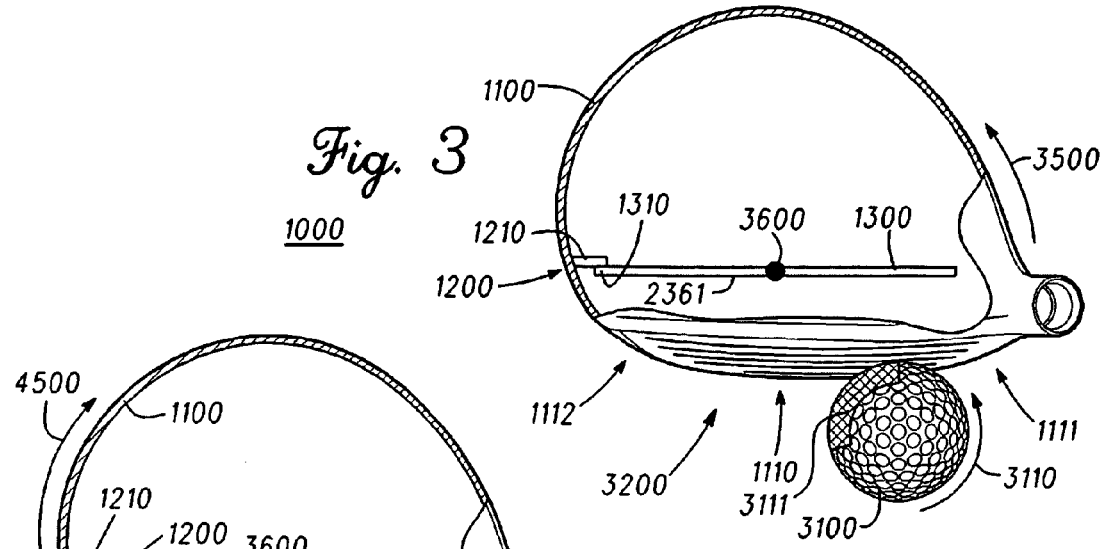
FIG. 3 illustrates a top cross-sectional view of part of the golf club head of FIG. 1 with a restrictor mechanism and interacting with a golf ball at a heel portion.
Figure 4:
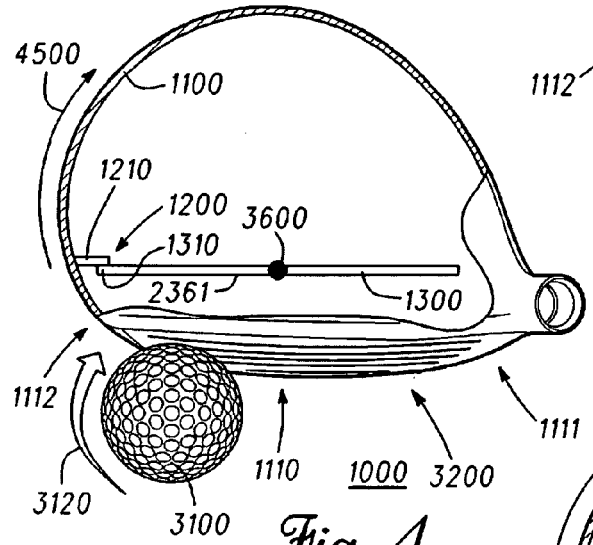
FIG. 4 illustrates a top cross-sectional view of part of the golf club head of FIG. 1 interacting with a golf ball at a toe portion.

Referring now to the figures, FIG. 1 illustrates a perspective cross-sectional view of part of golf club head 1000. FIG. 2 illustrates a top cross-sectional view of golf club head 1000. Parts of golf club head 1000 are omitted from FIGS. 1-2 for clarity. FIG. 3 illustrates a top cross-sectional view of part of golf club head 1000 with restrictor mechanism 1200 and interacting with golf ball 3100 at a heel portion of golf club head 1000. FIG. 4 illustrates a top cross-sectional view of part of golf club head 1000 interacting with golf ball 3100 at a toe portion of golf club head 1000.

Golf club head 1000 is illustrated herein as a driver head. It will be understood, however, that other embodiments of the present invention can comprise a different type of golf club head, such as a putter head, an iron head, a hybrid head, and a fairway wood head, among others. The teachings in this disclosure are not limited to any specific type of golf club or golf club head.

As illustrated in FIGS. 1-4, golf club head 1000 comprises a body 1100 having a front section 1110, a restrictor mechanism 1200, and a weight 1300. In some embodiments, front section 1110 can be referred to as a face, or can comprise a face of golf club head 1000. In the same or different embodiments, body 1100 can be referred to as a housing. In the same or a different embodiment, body 1100 can comprise at least one of a steel material, a titanium material, an aluminum material, a graphite material, and/or other suitable materials. Golf club head 1000 can form part of a golf club with a golf club shaft (not shown) coupled to a hose 1600 and/or a bore of golf club head 1000.

Restrictor mechanism 1200 of golf club head 1000 comprises restrictor 1210, and is coupled to body portion 1120 of body 1100. Body 1100 can also be subdivided into other portions, such as body portions 1130, 1140, 1150, and/or 2160 (FIG. 2). In the same or a different embodiment, front section 1110 can be at or proximate to a front 2111 of golf club head 1000, body portion 1120 can be at or proximate to a toe 2121 of golf club head 1000, body portion 1130 can be at or proximate to a heel 2131 of golf club head 1000, body portion 1140 can be at or proximate to a top 1141 of golf club head 1000, body portion 1150 can be at or proximate to a bottom 1151 of golf club head 1000, and/or body portion 2160 can be at or proximate to a back 2161 of golf club head 1000. Some embodiments may refer to body portions 1120, 1130, 1140, 1150, and/or 1160 as sections.

Weight 1300 is coupled to body 1100 and comprises weight end 1310 coupled to restrictor mechanism 1200. In the present embodiment, weight 1300 also comprises weight end 1320. Restrictor 1210 comprises a stiffness correlated with a Young's modulus of a material from which restrictor 1210 is made. In one example, restrictor 1210 comprises at least one of a steel material, a titanium material, an aluminum material, and/or any other suitable materials. In the same or a different embodiment, weight 1300 can comprise a mass of approximately 20 to 40 grams. In the same or a different embodiment, weight 1300 can comprise approximately 10 to 20 percent of a mass of golf club head 1000. In some embodiments, weight 1300 can comprise at least one of a tungsten material, a tungsten-epoxy material, a steel material, a copper material, a titanium material, and/or a bronze material.

As shown in FIGS. 1-2, weight 1300 of golf club head 1000 further comprises post 1380. In the present embodiment, post 1380 is coupled to body portions 1140 and 1150 of body 1100. In some embodiments, post 1380 can also be referred to as a restrictor, and can comprise a stiffness which can be less than a stiffness of restrictor 1210. Weight 1300 is at least as stiff as restrictor 1210 and can be stiffer than post 1380.

Post 1380 is configured to couple weight 1300 to body 1100, and to align weight end 1310 with restrictor 1210. In turn, restrictor 1210 is positioned behind end 1310 of weight 1300 relative to front section 1110 of body 1100 in the present embodiment. In addition, face 2361 (FIG. 2) of weight 1300 is aligned substantially parallel to front section 1110 of body 1100.

As shown in FIGS. 3-4 for the present embodiment, center of gravity 3600 of weight 1300 can be proximate to front section 1110 of golf club head 1000. In the same or a different example, center of gravity 3600 of weight 1300 can be proximate to a center of gravity of golf club head 1000. In a different example, center of gravity 3600 of weight 1300 can be proximate to a geometric center of golf club head 1000. In the same or a different example, center of gravity 3600 is substantially collinear with a gravitational vector through the center of gravity of golf club head 1000.

As shown in FIG. 3, the stiffness of restrictor 1210 is configured to resist a deformation of restrictor 1210 by end 1310 of weight 1300 in response to an impact at zone 1111 of body 1100. Restrictor mechanism 1200 can thus interact with weight end 1310 by resisting deformation of restrictor 1210 due to its stiffness. In other embodiments, the stiffness can be configured to permit certain deformation of restrictor 1210 to interact with weight end 1310. In the same or a different embodiment, deformation of restrictor 1210 can be elastic but restrictor 1210 may return to its original shape after deformation. In some embodiments, a deformation of a restrictor such as restrictor 1210 can be referred to as a distortion.

In the present example of FIG. 3, face 3200 of golf club head 1000 impacts ball 3100 substantially square with respect to an intended direction of travel for golf ball 3100. The impact at zone 1111 is proximate to the heel of golf club head 1000 in this example; thus imparting a counterclockwise rotation upon golf club head 1000, as denoted by arrow 3500. In the current embodiment, and for simplicity of description and illustration, the counterclockwise rotation is about center of gravity 3600. In other embodiments, golf club head 1000 can rotate about a different point.

Continuing with the example of FIG. 3, the counterclockwise rotation of golf club head 1000 causes restrictor 1210 to also rotate counterclockwise along with body 1100 and, as a result, to interact with end 1310 of weight 1300. As restrictor 1210 is pressed against weight end 1310, restrictor 1210 resists deformation due to its stiffness. As a result, the moment of inertia of weight 1300 is transferred through restrictor 1210 onto body 1100. In some embodiments, restrictor 1210 also impedes a rotational tendency of weight 1300 relative to body 1100 when golf club head 1000 rotates counterclockwise in response to impact with golf ball 3100. Golf club head 1000 therefore exhibits a higher moment of inertia when weight 1300 interacts with restrictor 1210, decreasing the amount of corresponding rotation 3500 imparted onto golf club head 1000 upon impact with golf ball 3100.

As illustrated in FIG. 4, weight 1300 may not affect the rotation and/or the moment of inertia of golf club head 1000. In the situation presented in FIG. 4, face 3200 of golf club head 1000 impacts ball 3100 proximate to zone 1112 of front section 1110. The impact at zone 1112 is proximate to the toe of golf club head 1000 in this example, thus imparting a clockwise rotation upon golf club head 1000, as denoted by arrow 4500.

The clockwise rotation of golf club head 1000 causes restrictor 1210 (which is fixed relative to body 1100) to also rotate clockwise along with body 1100, but the lower stiffness of post 1380 causes post 1380, and thus weight 1300, to deform with respect to body 1100. Because restrictor 1210 tends to rotate away from weight end 1310, any interaction between restrictor 1210 and weight 1300 is limited and/or restricted and, as a result, the moment of inertia of weight 1300 may not be transferred through restrictor 1210 onto body 1100. Golf club head 1000 therefore exhibits a lower moment of inertia in this situation, compared to the scenario of FIG. 3. In the same or a different embodiment, restrictor 1210 is neutral with respect to impeding a rotational tendency of weight 1300 relative to body 1100 when golf club head 1000 rotates clockwise in response to impact at zone 1112 with golf ball 3100. As a result, in the present example of FIG. 4, the amount of rotation imparted onto golf club head 1000 upon impact with golf ball 3100 is less affected by the mass of weight 1300. Therefore, golf club head 1000 rotates more in the clockwise direction in FIG. 4 than in the counterclockwise direction in the example of FIG. 3.

FIGS. 3-4 therefore illustrate that a weight, such as weight 1300, and a restrictor mechanism, such as restrictor mechanism 1200, can be configured to selectively impart a greater or lesser moment of inertia onto a golf club head depending on a degree of deformation of a restrictor in response to impact at specific zones of the golf club head. As will be described in detail below, other alignments and combinations of weights and restrictor mechanisms can be used to selectively control the transfer of moments of inertia onto golf club heads.

Regardless of their deformation, or lack thereof, none of the elements of the golf club heads described herein are designed to move. For example, all of weight 1300, restrictor 1210, and post 1380 of golf club head 1000 are fixed relative to body 1100. In addition, any deformation of elements of the golf club heads described herein, including any deformation of weight 1300, restrictor 1210, and/or post 1380 of golf club head 1000, can be designed to be temporary in the same way that face 3200 of golf club head 1000 temporarily deforms upon impact with golf ball 3100.

Figure 5:
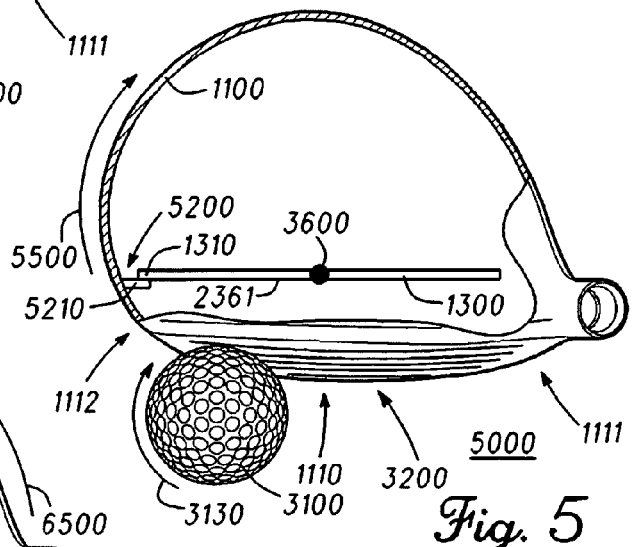
FIG. 5 illustrates a top cross-sectional view of part of a golf club head comprising a different restrictor mechanism and interacting with the golf ball at the heel portion.
Figure 6:
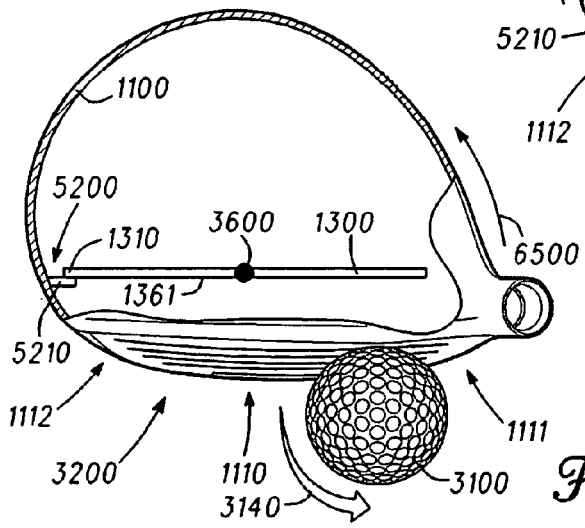
FIG. 6 illustrates a top cross-sectional view of part of the golf club head of FIG. 5 and interacting with the golf ball at the toe portion.

Continuing with the Figures, FIG. 5 illustrates a top cross-sectional view of part of golf club head 5000 comprising restrictor mechanism 5200 and interacting with golf ball 3100 at a heel portion of golf club head 5000. FIG. 6 illustrates a top cross-sectional view of part of golf club head 5000 comprising restrictor mechanism 5200 and interacting with golf ball 3100 at a toe portion of golf club head 5000. Golf heads 1000 (FIGS. 1-4) and 5000 (FIGS. 5-6) can be similar to each other, except that they have different restrictor mechanisms.

Restrictor mechanism 5200 in FIGS. 5-6 comprises restrictor 5210, and differs from restrictor mechanism 1200 in FIGS. 1-4 in that restrictor 5210 is positioned between end 1310 of weight 1300 and front section 1110 of body 1100. Restrictor 5210 is similar to restrictor 1210 (FIGS. 1-4) and can also comprise the same stiffness. In the example of FIG. 5, face 3200 of golf club head 5000 impacts golf ball 3100 proximate to zone 1112 of front section 1110. The impact at zone 1112 is proximate to the toe of golf club head 5000 in this example, thus imparting a clockwise rotation upon golf club head 5000, as denoted by arrow 5500.

The position of restrictor 5210 in this example produces a situation analogous but opposite to the situation described in FIG. 3, where restrictor mechanism 5200 here can reduce a rotation of golf club head 5000. The rotation is now clockwise and causes restrictor 5210 to also rotate clockwise along with body 1100 and, as a result, to interact with end 1310 of weight 1300. As restrictor 5210 is pressed against weight end 1310, restrictor 5210 resists deformation due to its stiffness. As a result, the moment of inertia of weight 1300 is transferred through restrictor 5210 onto body 1100. Golf club head 5000 therefore exhibits a higher moment of inertia when weight 1300 interacts with restrictor 5210, decreasing the amount of corresponding rotation imparted onto golf club head 5000 upon impact with golf ball 3100.

As illustrated in FIG. 6, restrictor 5210 and weight 1300 need not always affect the rotation and/or the moment of inertia of golf club head 1000. In the present example of FIG. 6, face 3200 of golf club head 1000 impacts ball 3100 proximate to the heel of golf club head 1000, thus imparting a counterclockwise rotation upon golf club head 1000, as denoted by arrow 6500.

The positioning of restrictor 5210 in this example produces a situation analogous but opposite to the situation described in FIG. 4, where restrictor mechanism 5200 may not affect the counterclockwise rotation 6500 of golf club head 1000. Restrictor 5210 also rotates counterclockwise along with body 1100, tending to rotate away from weight end 1310 such that any interaction between restrictor 1210 and weight 1300 is limited and/or restricted. As a result, the moment of inertia of weight 1300 may not be transferred through restrictor 5210 onto body 1100. Golf club head 5000 therefore exhibits a lower moment of inertia in this situation, compared to the scenario of FIG. 5. As a result, in the present example of FIG. 6, the amount of rotation 6500 imparted onto golf club head 1000 upon impact with golf ball 3100 is less affected by the mass of weight 1300. Therefore, golf club head 5000 rotates more in the counterclockwise direction in FIG. 6 than in the clockwise direction in the example of FIG. 5.

Figures 7, 8, 9, 10:
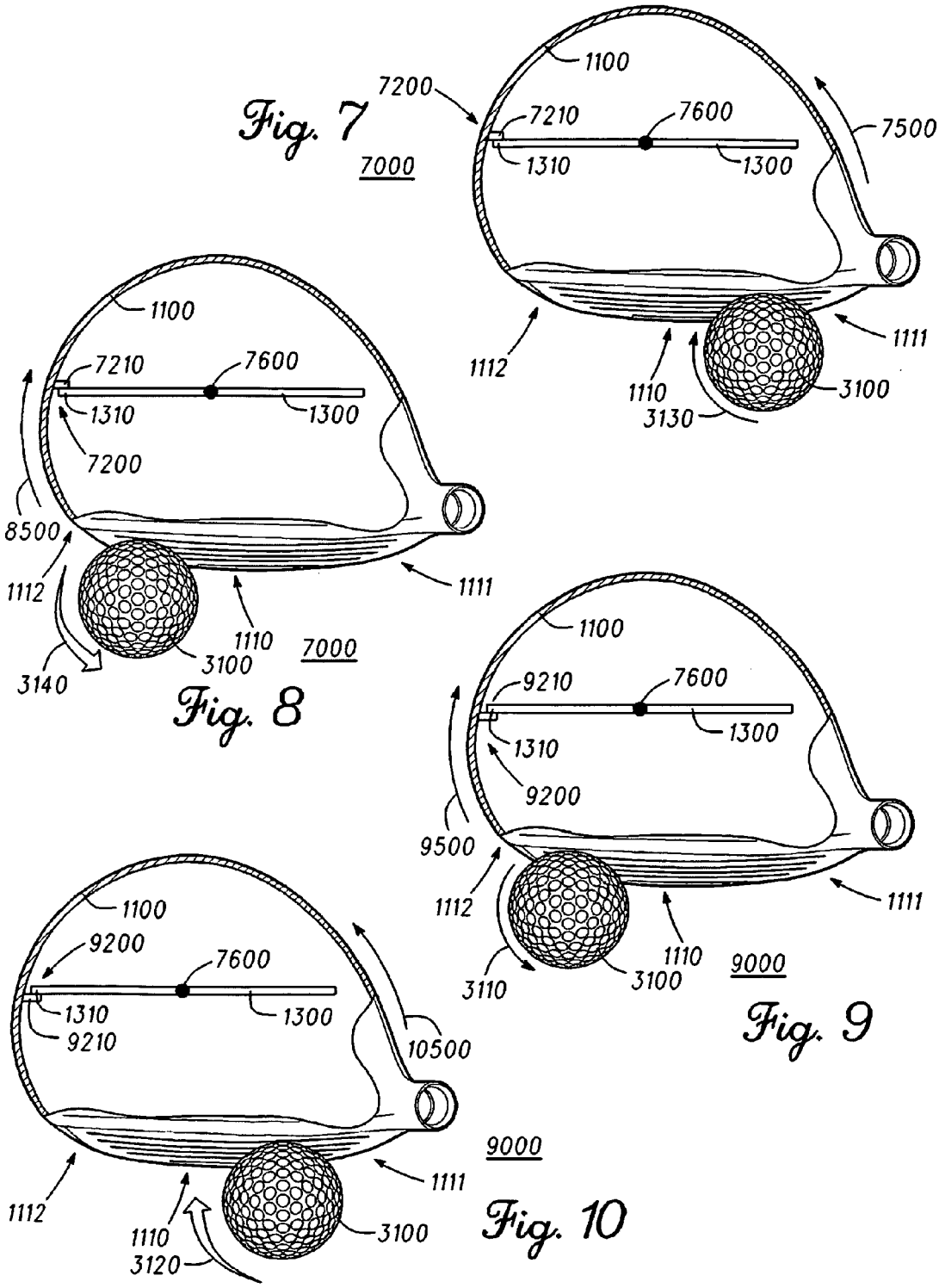
FIG. 7 illustrates a top cross-sectional view of part of a golf club head comprising another restrictor mechanism and interacting with the golf ball at a heel portion.
FIG. 8 illustrates a top cross-sectional view of part of the golf club head of FIG. 7 interacting with the golf ball at a toe portion of golf club head of FIG. 7.
FIG. 9 illustrates a top cross-sectional view of part of a golf club head comprising yet another restrictor mechanism and interacting with the golf ball at the toe portion.
FIG. 10 illustrates a top cross-sectional view of part of the golf club head of FIG. 9 interacting with the golf ball at the heel portion.

Continuing with the figures, FIG. 7 illustrates a top cross-sectional view of part of golf club head 7000, comprising restrictor mechanism 7200 and interacting with golf ball 3100 at a heel portion of golf club head 7000. FIG. 8 illustrates a top cross-sectional view of part of golf club head 7000, comprising restrictor mechanism 7200 and interacting with golf ball 3100 at a toe portion of golf club head 7000.

Golf club heads 1000 (FIGS. 1-4) and 7000 (FIGS. 7-8) can be similar to each other, except that they have different restrictor mechanisms and that center of gravity 7600 (FIG. 7) is proximate to a geometric center of golf club head 7000. This contrasts with center of gravity 3600 for golf club head 1000 (FIGS. 3-6), positioned proximate to front section 1110. Like golf club head 1000, golf club head 7000 also comprises weight 1300.

The example shown in FIGS. 7-8 illustrates restrictor 7210 positioned behind weight end 1310 of weight 1300, relative to front section 1110. FIG. 7 shows a scenario similar to the scenario described for FIG. 3 above, where an impact with golf ball 3100 at zone 1111 of front section 1110 produces a counterclockwise rotation 7500 of golf club head 7000. This counterclockwise rotation 7500 is restricted by an interaction between restrictor 7210 and weight end 1310. FIG. 8 shows a scenario similar to the scenario described for FIG. 4, where an impact with golf ball 3100 at zone 1112 of front section 1110 produces a clockwise rotation 8500 of golf club head 7000. This clockwise rotation 7500 may be unrestricted due to a lack of interaction between restrictor 7210 and weight end 1310.

FIG. 9 illustrates a top cross-sectional view of part of golf club head 9000 comprising restrictor mechanism 9200 and interacting with golf ball 3100 at the toe portion of golf club head 7000. FIG. 10 illustrates a top cross-sectional view of part of golf club head 9000 comprising restrictor mechanism 9200 and interacting with golf ball 3100 at the heel portion of golf club head 9000. Golf club heads 7000 (FIGS. 7-8) and 9000 (FIGS. 9-10) can be similar to each other, except that they have different restrictor mechanisms.

The examples shown in FIGS. 9-10 illustrates restrictor 9210 positioned between weight end 1310 and front section 1110. FIG. 9 shows a scenario similar to the scenario described for FIG. 5 above, where an impact with ball 3100 at zone 1112 of front section 1110 produces a clockwise rotation 9500 of golf club head 7000. This clockwise rotation 9500 is restricted by interaction between restrictor 9210 and weight end 1310. FIG. 10 shows an example similar to as described for FIG. 6, where an impact with golf ball 3100 at zone 1112 of front section 1110 produces a counterclockwise rotation 10500 of golf club head 7000. This clockwise rotation 10500 may be unrestricted due to a lack of interaction between restrictor 9210 and weight end 1310.

As described for FIGS. 1-10, the moment of inertia of a golf club and/or golf club head can be varied as desired by positioning weights and restrictors with certain resistance to deformation, such as weight 1300 and restrictors 1210 (FIGS.

1-4) and 5210 (FIGS. 5-6), to restrict or permit a rotation of the golf club head in response to impact. Because the amount of rotation of a golf club head can affect a flight trajectory of a golf ball by inducing spin upon impact, mechanisms such as those mechanisms described herein can be used to counteract specific tendencies of particular individuals who golf, such as a tendency to hook, draw, pull, push, fade, and/or slice a golf ball.

FIGS. 3-10 illustrate different effects that weight 1300 and restrictor mechanisms 1200, 5200, 7200, and 9200 can have on spin imparted upon golf ball 3100 in response to impact. In the example of FIGS. 4, 6, 8, and 10, due to lesser interaction between weight end 1310 and restrictors 1210, 5210, 7210, and 9210, respectively, the moment of inertia of weight 1300 may not be transferred to body 1100 to restrict golf club head rotations 4500, 6500, 8500, and 10500, respectively. Because the rotation of golf club heads 1000, 5000, 7000 and 9000 is less restricted, or unrestricted, by weight 1300, greater spin 3120 and 3140 can be imparted upon golf ball 3100. In contrast, in the examples of FIGS. 3, 5, 7, and 9, due to greater interaction between weight end 1310 and restrictors 1210, 5210, 7210, and 9210, respectively, the moment of inertia of weight 1300 is transferred to body 1100 to restrict golf club head rotations 3500, 5500, 7500, and 9500, respectively. Because the rotation of golf club heads 1000 and 7000 is thus restricted, lesser spin 3110 and 3130 can be imparted upon golf ball 3100.

In some embodiments, the direction of spin imparted on golf ball 3100 can be affected by the positioning of weights and restrictors as illustrated in FIGS. 3-10. As an example, FIG. 3 illustrates golf club 1000 imparting counterclockwise spin 3110, while FIG. 7 illustrates golf club 7000 imparting clockwise spin 3130. As previously described, golf club heads 1000 and 7000 differ in that center of gravity 3600 in FIGS. 3-6 is positioned proximate to front section 1110, while center of gravity 7600 in FIGS. 7-10 is positioned further away from front section 1110. For FIG. 7, the counterclockwise rotation of golf club head 7000 around center of gravity 7600, due to contact with the surface of golf ball 3100, generates an opposite clockwise spin 3130 on golf ball 3100. In contrast, for FIG. 3, because of the forward positioning of center of gravity 3600, a greater amount of mass is available at the rear of golf club head 1000 to pivot around center of gravity 3600, causing front section 1110 to slide across surface 3111 of golf ball 3100, thereby producing counterclockwise spin 3110 on golf ball 3100.

Figure 11:
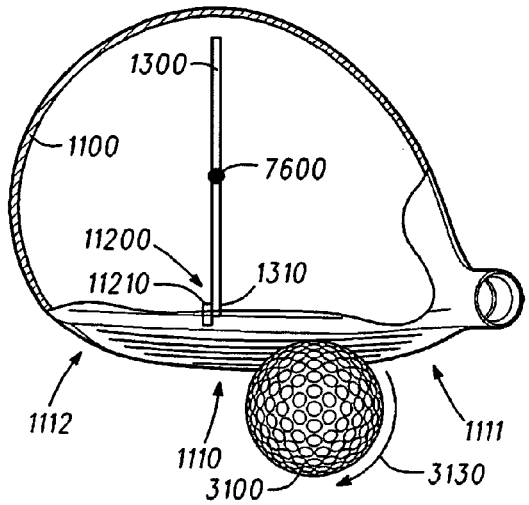
FIG. 11 illustrates a top cross-sectional view of part of a golf club head comprising a further restrictor mechanism interacting with the golf ball at the heel portion.
Figure 12:
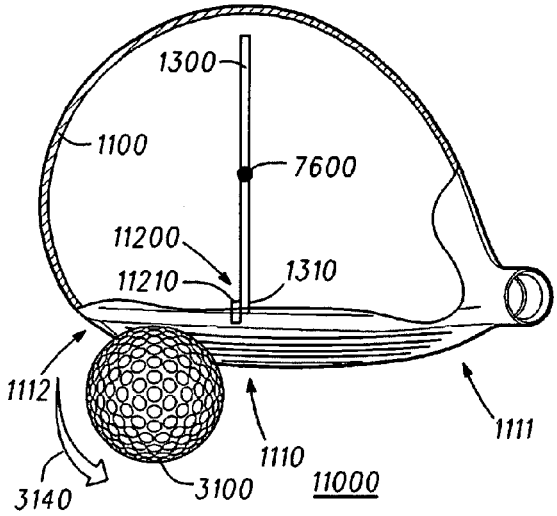
FIG. 12 illustrates a top cross-sectional view of part of the golf club head of FIG. 11 interacting with the golf ball at a toe portion.
Figure 13:
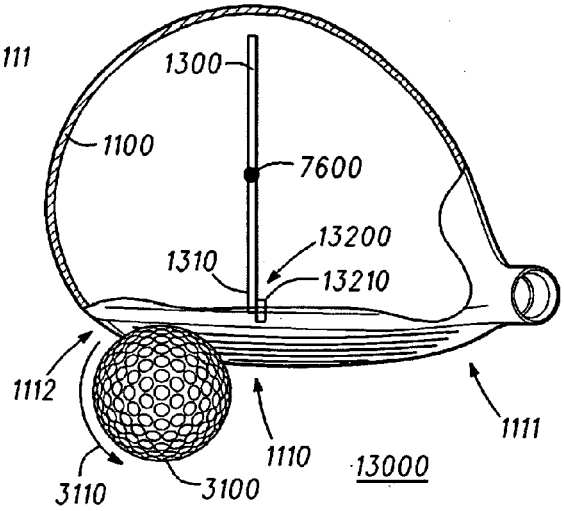
FIG. 13 illustrates a top cross-sectional view of part of a golf club head comprising another different restrictor mechanism and interacting with the golf ball at the toe portion.
Figure 14:
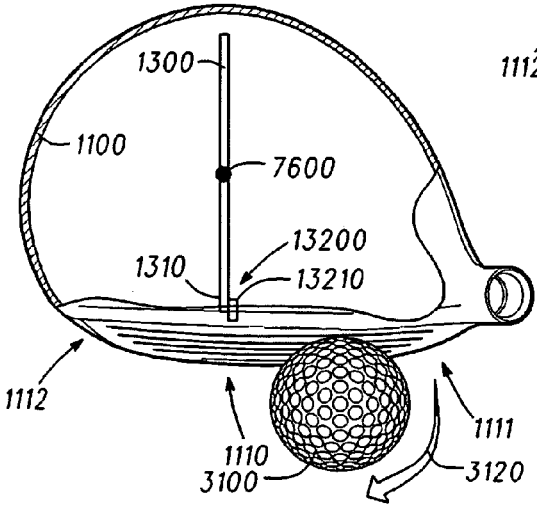
FIG. 14 illustrates a top cross-sectional view of part of the golf club head of FIG. 13 interacting with the golf ball at the heel portion.

Although the embodiments in FIGS. 1-10 have been presented having weight 1300 aligned substantially parallel to the front section of golf club heads 1000 and 7000, other alignments can be used to achieve similar results. For example, FIG. 11 illustrates a top cross-sectional view of part of golf club head 11000 comprising restrictor mechanism 11200 and interacting with golf ball 3100 at a heel portion of golf club head 9000. FIG. 12 illustrates a top cross-sectional view of part of golf club head 11000 comprising restrictor mechanism 11200 and interacting with golf ball 3100 at a toe portion of golf club head 11000. FIG. 13 illustrates a top cross-sectional view of part of golf club head 13000, comprising restrictor mechanism 13200, and interacting with golf ball 3100 at the toe portion of golf club head 13000. FIG. 14 illustrates a top cross-sectional view of part of golf club head 13000 comprising restrictor mechanism 13200 and interacting with golf ball 3100 at the heel portion of golf club head 13000. Golf club heads 1000 (FIGS. 1-4), 11000 (FIGS. 11-12), and 13000 (FIGS. 13-14) can be similar to each other, except that they have different restrictor mechanisms.

FIGS. 11-14 illustrate embodiments where a face of weight 1300 is aligned substantially perpendicular to front section 1110 of body 1100 of golf club head 7000. Restrictor mechanisms 11200 and 13200 are accordingly positioned proximate to front section 1110 to align with weight end 1310. In a different embodiment, restrictor mechanisms 11200 and 13200 can be positioned proximate to a rear of the golf club heads, opposite front section 1110.

Despite the different alignments, the embodiments in FIGS. 11-14 can perform in a manner similar to the embodiments in FIGS. 7-10, respectively, upon impact with golf ball 3100. For example, the situations shown in FIGS. 11 and 13 are likely to generate an interaction between weight end 1310 and restrictors 11210 and 13210, respectively, similar to as previously described for the analogous situations shown in FIGS. 7 and 9. Similarly, the situations shown in FIGS. 12 and 14 are less likely to generate an interaction between weight end 1310 and restrictors 11210 and 13210, respectively, similar to as previously described for the analogous situations shown in FIGS. 8 and 10.

Figure 15:
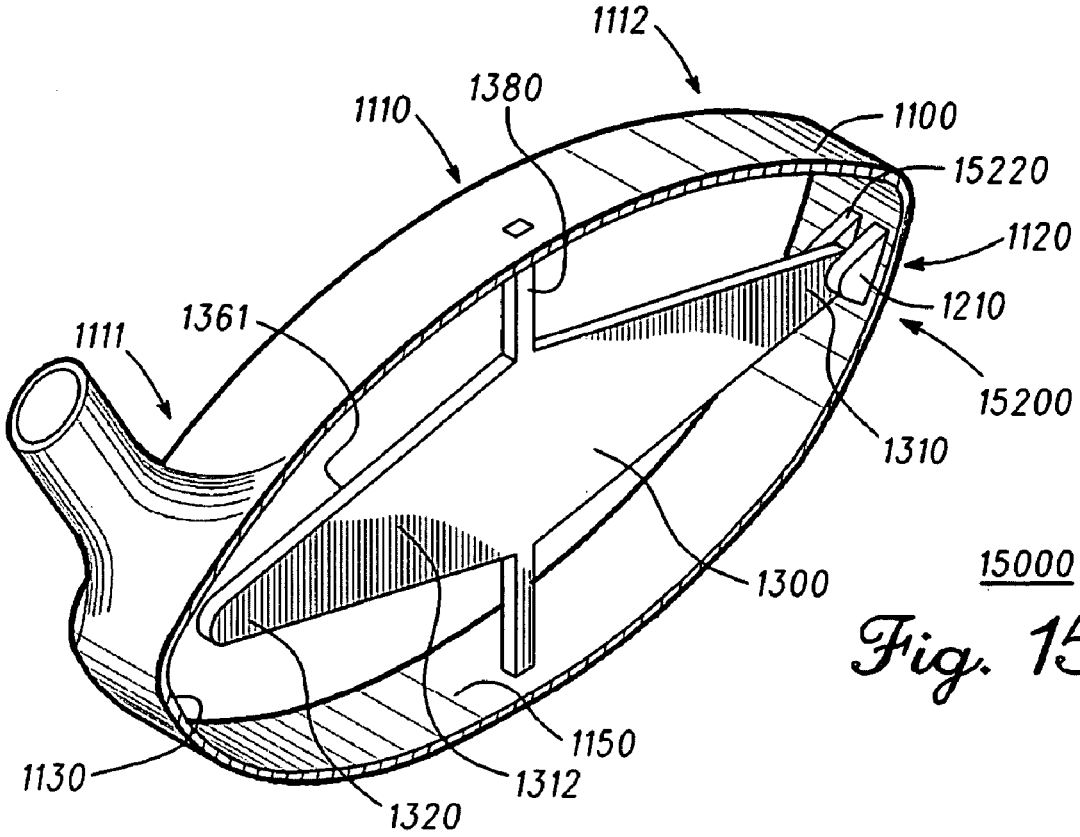
FIG. 15 illustrates a perspective cross-sectional view of part of a golf club head comprising one dual-restrictor mechanism.
Figure 16:
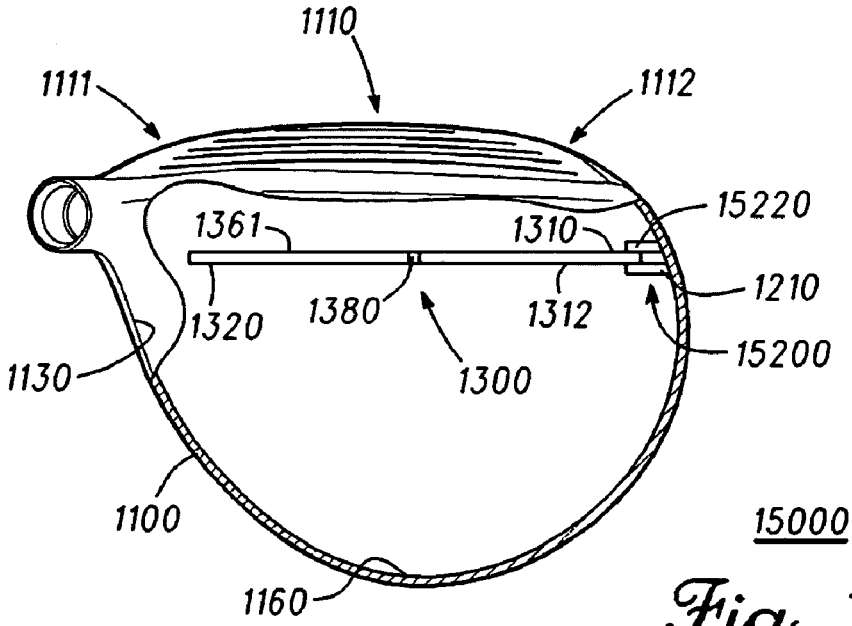
FIG. 16 illustrates a top cross-sectional view of part of the golf club head of FIG. 15.

Continuing with the figures, FIG. 15 illustrates a perspective cross-sectional view of part of golf club head 15000 comprising one dual-restrictor mechanism. FIG. 16 illustrates a top cross-sectional view of golf club head 15000. Golf club head 15000 is similar to golf club head 1000, but comprises restrictor mechanism 15200 rather than 1200. Restrictor mechanism 15200 comprises restrictor 1210 similar to as described above for restrictor mechanism 1200 in FIGS. 1-2. However, restrictor mechanisms 15200 and 1200 (FIGS. 1-2) differ in that restrictor mechanism 15200 is a dual-restrictor mechanism that further comprises restrictor 15220 located at an opposite side of weight 1300 than restrictor 1210. In addition, weight end 1310 of weight 1300 is configured to be positioned between restrictors 1210 and 15220. In the same or a different embodiment, weight end 1310 is within body 1100.

In the present embodiment of FIGS. 15-16, restrictor 15220 comprises a stiffness, where the stiffness of restrictor 1210 is greater than the stiffness of restrictor 15220. Here, the stiffness of restrictor 15220 is configured to permit a deformation of restrictor 15220 by weight end 1310 in response to an impact at zone 1112 of body 1100 of golf club head 15000. The impact at zone 1112 could be, for example, with golf ball 3100. In the same or a different embodiment, restrictor 15220 can comprise at least one of a silicon material, a polymer material, and an epoxy material. In a different embodiment, the relative stiffnesses of restrictors 1210 and 15220 could be inverted, such that stiffness 15221 could be greater than stiffness 1211. In the same or a different embodiment, weight end 1310 can be connected to at least one of restrictors 1210 and 15220, such as by welding, bonding, soldering, and/or gluing, among other techniques.

In the example of FIGS. 15-16, when golf club head 15000 rotates counterclockwise upon an impact at zone 1111, restrictor 1210 tends to interact with weight end 1310. Because the stiffness of restrictor 1210 is greater than the stiffness of restrictor 15220, restrictor 1210 tends to resist deformation due to the interaction, and thus may transfer a comparatively greater moment of inertia from weight 1300 to body 1100 of golf club head 15000. Conversely, when golf club head 15000 rotates clockwise upon an impact at zone 1112, restrictor 15220 may interact with weight end 1310. Because the stiffness of restrictor 15220 is less than the stiffness of restrictor 1210 in this example, restrictor 15220 tends to deform and/or compress due to the interaction, and thus may transfer a comparatively lesser moment of inertia from weight 1300 to body 1100 of golf club head 15000.

Figure 17:
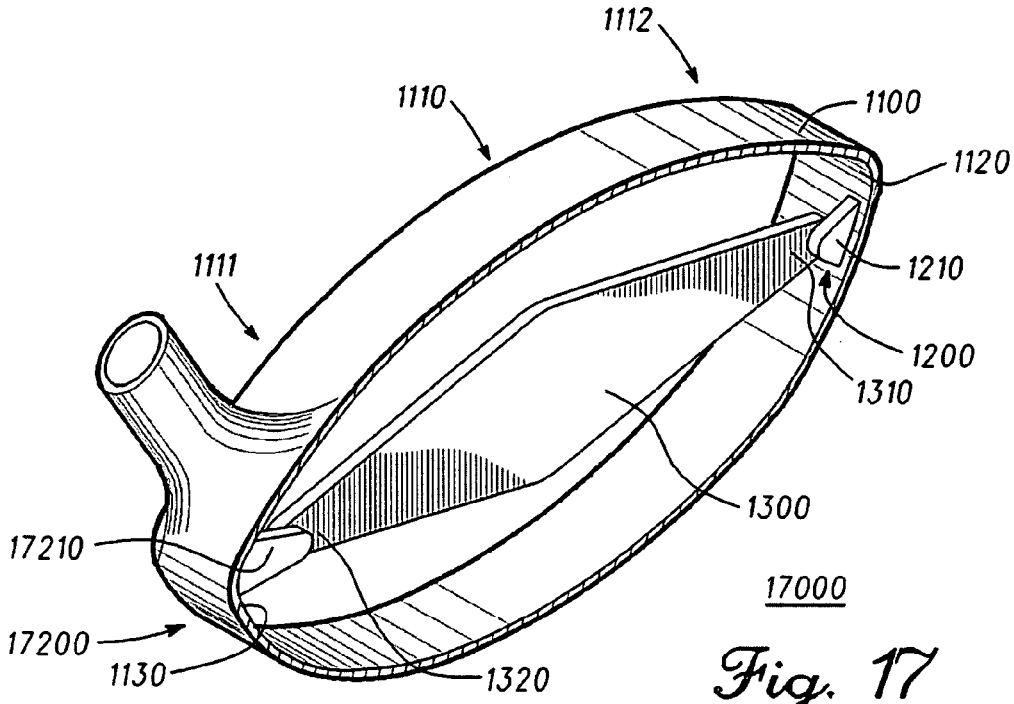
FIG. 17 illustrates a perspective cross-sectional view of part of a golf club head comprising two single-restrictor mechanisms.

Carrying on with the figures, FIG. 17 illustrates a perspective cross-sectional view of part of golf club head 17000 comprising two single-restrictor mechanisms. In the present embodiment, golf club head 17000 is similar to golf club head 1000 (FIGS. 1-2), but differs by having restrictor mechanism 17200. Restrictor mechanism 17200 comprises restrictor 17210 and is coupled to body portion 1130 of body 1100. In the present embodiment, body portion 1130 is located substantially opposite to body portion 1120 of body 1100, such that restrictor mechanism 17200 is located substantially opposite to restrictor mechanism 1200. Golf club head 17000 also differs from golf club head 1000 in that weight 1300 does not couple to body 1100 via post 1380. Instead, weight 1300 comprises weight end 1320 coupled to restrictor 17210. In the same embodiment, weight end 1310 can be coupled to restrictor 1210.

In one embodiment, restrictor 17210 comprises a stiffness less than the stiffness of restrictor 1210. The stiffness of restrictor 17210 is configured to permit a deformation of restrictor 17210 by weight end 1320 of weight 1300 in response to impact at front section 1110 of body 1100. In the present example, restrictor 17210 may deform whether impact occurs proximate to zones 1111 or 1112. In addition, even though weight 1300 is coupled to body 1100 in a different manner, the interaction between weight end 1310 and restrictor 1210 is similar to as described above for FIGS. 1-4. In a different embodiment, restrictor 1210 can be positioned similar to restrictor 15220 from FIGS. 15-16.

Figure 18:
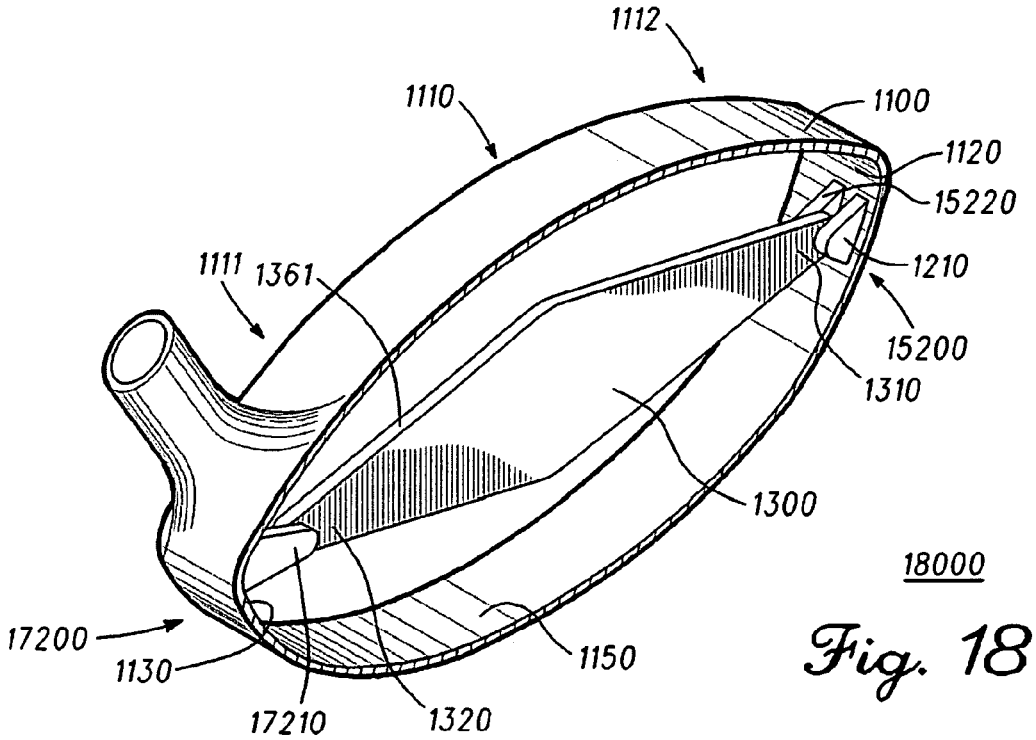
FIG. 18 illustrates a perspective cross-sectional view of part of a golf club head comprising one single-restrictor mechanism and one dual-restrictor mechanism.

FIG. 18 illustrates a perspective cross-sectional view of part of golf club head 18000 comprising one single-restrictor mechanism and one dual-restrictor mechanism. FIG. 19 illustrates a top cross-sectional view of part of golf club head 18000. In the present embodiment of FIGS. 18-19, golf club head 18000 is similar to golf club head 15000 (FIGS. 15-16), comprising restrictor mechanism 15200, and having weight end 1310 between restrictors 1210 and 15220. Golf club head 18000 differs from golf club head 15000 by comprising restrictor mechanism 17200, as described for FIG. 17. Weight 1300 can be attached to restrictors 15220 and 17210.

In the present example, restrictor 1210 comprises a stiffness greater than the stiffness for restrictor 15220. The stiffness for restrictor 15220 is configured to permit a deformation of restrictor 15220 by weight end 1310 in response to an impact at zone 1112 of body 1100 of golf club head 18000. As a result, less inertia can be transferred from weight 1300 to golf club head 18000 when body 1100 rotates clockwise than when body 1100 rotates counterclockwise. In a different embodiment, the locations of restrictors 1210 and 15220 could be swapped, causing a corresponding change in the transfer of inertia.

FIG. 20 illustrates a perspective cross-sectional view of part of golf club head 20000 comprising two dual-restrictor mechanisms. FIG. 21 illustrates a top cross-sectional view of part of golf club head 20000. Golf club head 20000 is similar to golf club head 18000 (FIGS. 18-19), but comprises restrictor mechanism 20200. Restrictor mechanism 20200 is similar to restrictor mechanism 17200 (FIGS. 17-19), but further comprises restrictor 20220 opposite restrictor 17210. In addition, weight end 1320 is between restrictors 17210 and 20220. Weight 1300 can be attached to restrictors 15220 and 17210.

In the present example, a stiffness of restrictor 20220 is similar to the stiffness of restrictor 1210. Similarly, the stiffness of restrictor 17210 is similar to the stiffness of restrictor 15220. The stiffness of restrictor 17210 is configured to permit a deformation of restrictor 17210 by weight end 1320 in response to impact at zone 1112 of body 1100 of golf club head 20000. In contrast, the stiffness of restrictor 20220 is configured to resist a deformation of restrictor 20220 by weight end 1320 in response to impact at zone 1111 of body 1100 of golf club head 20000. In a different embodiment, the stiffnesses of restrictors 1210, 15220, 17220, and 20220 can be altered to achieve a desired transfer of moment of inertia to golf club head 20000 from weight 1300 upon impact at different parts of front section 1110.

Figure 22:
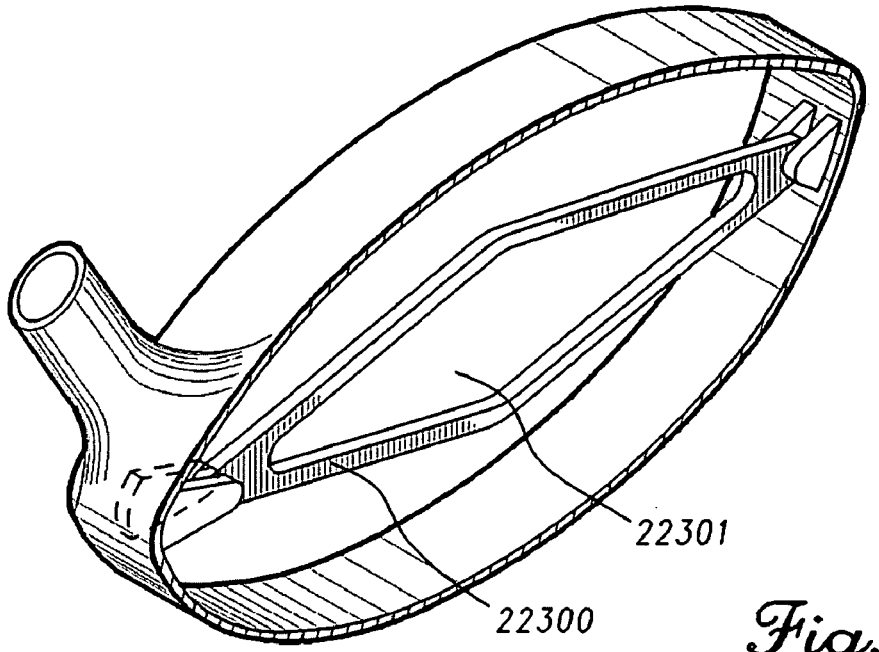
FIG. 22 illustrates a perspective cross-sectional view of part of a golf club head comprising a weight with a mass-cutout.

FIG. 22 illustrates a perspective cross-sectional view of part of golf club head 22000 comprising a weight with a mass-cutout. Golf club head 22000 is similar to golf club head 20000, but comprises instead weight 22300. Weight 22300 comprises a mass cutout 22301, in contrast with weight 1300 of FIGS. 1-21. Mass cutout 22301 can be made larger or smaller to adjust the amount of inertia that can be transferred from weight 22300 to golf club head 22000.

Figure 23:
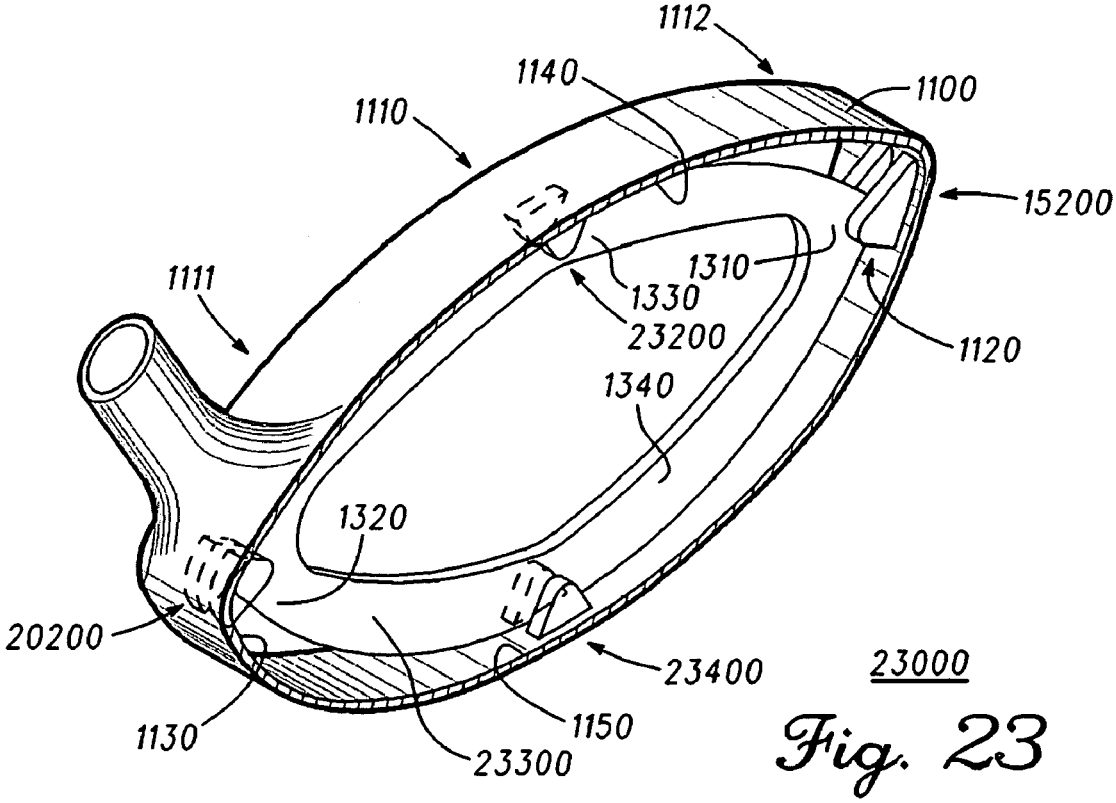
FIG. 23 illustrates a perspective cross-sectional view of part of a golf club head comprising four dual-restrictor mechanisms.

FIG. 23 shows a perspective cross-sectional view of part of golf club head 23000 comprising four dual-restrictor mechanisms. The four dual-restrictor mechanisms here can be similar to any of restrictor mechanisms 15200 and 20200 described above for FIGS. 18-21. In the present example of FIG. 23, golf club head 23000 is similar to golf club head 20000 (FIGS. 20-21), comprising restrictor mechanism 15200 coupled to body portion 1120, and restrictor mechanism 20200 coupled to body portion 1130. Golf club head 23000 differs by comprising restrictor mechanism 23200, coupled to body portion 1140 between body portions 1120 and 1130, and restrictor mechanism 23400 coupled to body portion 1150 substantially opposite to body portion 1140. In the present example, golf club head 23000 comprises weight 23300, with weight end 1310 coupled to restrictor mechanism 15200, weight end 1320 substantially opposite weight end 1310 and coupled to restrictor mechanism 20200, weight end 1330 coupled to restrictor mechanism 23200, and weight end 1340 substantially opposite weight end 1330 and coupled to restrictor mechanism 23400. In some embodiments restrictor mechanisms 23200 and 23400 can be used to control a vertical spin of golf ball 3100, similar to the way restrictor mechanisms 15200 and/or 20200 can be used to control a horizontal spin of golf ball 3100 upon impact, as described above for FIGS. 20-21. In a different embodiment, golf club head can comprise a weight similar to weight 23300 but with no mass cutout, and/or one or more of the four dual-restrictor mechanisms can instead be single-restrictor mechanisms similar to restrictor mechanisms 1200 (FIGS. 1-2), and 17200 (FIG. 17).

Figure 24:
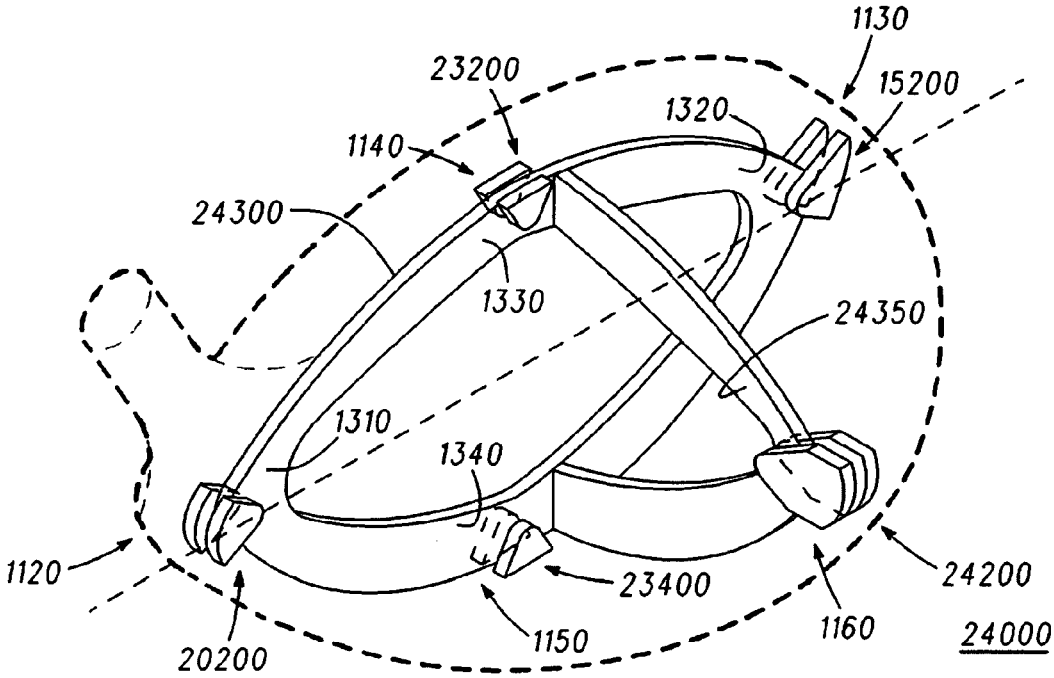
FIG. 24 illustrates a perspective cross-sectional view of part of a golf club head comprising five dual-restrictor mechanisms.
Figure 25:
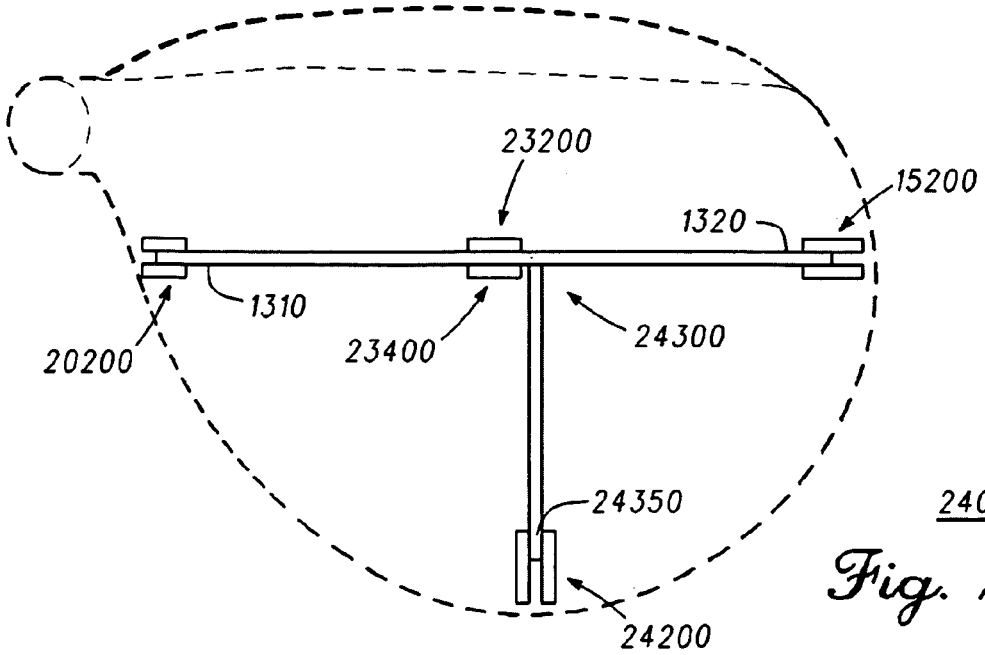
FIG. 25 illustrates a top cross-sectional view of part of the golf club head of FIG. 24.

FIG. 24 illustrates a perspective cross-sectional view part of golf club head 24000 comprising five dual-restrictor mechanisms. Body 1100 of golf club head 24000 is shown in a dashed outline form in FIG. 24 for clarity. FIG. 25 illustrates a top cross-sectional view of part of golf club head 24000. Golf club head 24000 is similar to golf club head 23000 (FIG. 23), but further comprises restrictor mechanism 24200 coupled to body portion 1160. Golf club head 24000 also comprises weight 24300, similar to weight 23300 (FIG. 23), but further comprising weight end 24350. Weight end 24350 is configured to be coupled to restrictor mechanism 24200. In the present embodiment, weight ends 1310, 1320, 1330, and 1340 are located along one plane of weight 24300, and weight end 24350 is located along another (perpendicular) plane of weight 24300. In a different embodiment golf club head 24000 could comprise a weight similar to weight 24300 but without mass cutouts, and one or more of the dual-restrictor mechanisms could instead be single-restrictor mechanisms.

Figure 26:
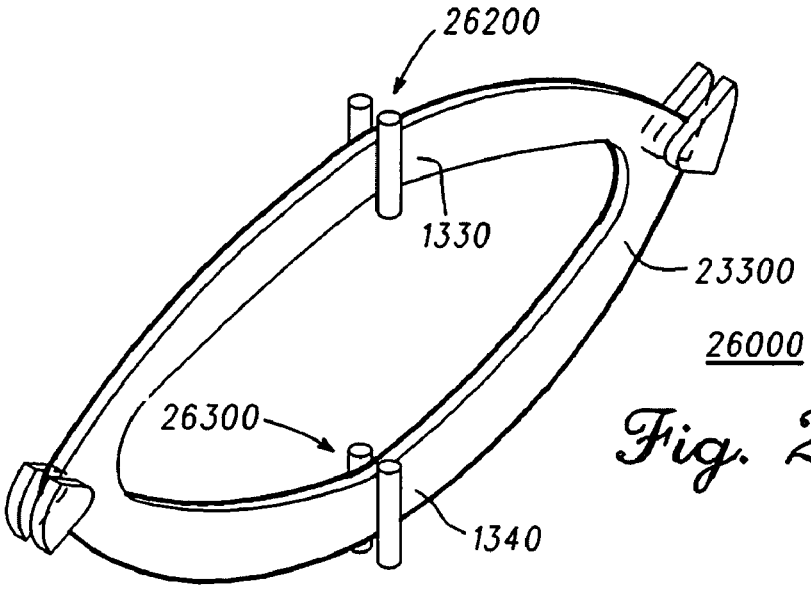
FIG. 26 illustrates a perspective cross-sectional view part of a golf club head comprising two dual-restrictor mechanisms and two hingepin restrictor mechanisms.

Continuing with the figures, FIG. 26 shows a perspective cross-sectional view of part of golf club head 26000 comprising two dual-restrictor mechanisms and two hingepin restrictor mechanisms. Body 1100 of golf club head 26000 is not shown in FIG. 26 for clarity. Golf club head 26000 is similar to golf club head 23000 (FIG. 23) but differs by comprising restrictor mechanism 26200 coupled to weight end 1330, and restrictor mechanism 26300 coupled to weight end 1340. Restrictor mechanism 26200 comprises hingepins straddling weight end 1330. Similarly, restrictor mechanism 26300 comprises hingepins straddling weight end 1340. The hingepins need not be bonded or otherwise fastened to weight 23300.

Figure 27:
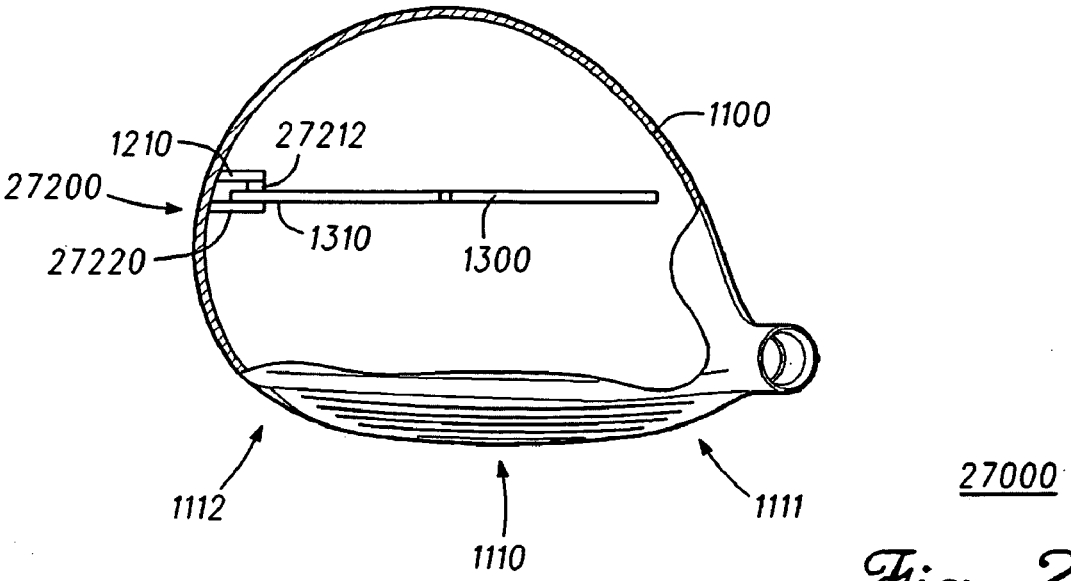
FIG. 27 illustrates a top cross-sectional view of part of a golf club head with a coupler restrictor mechanism.

Carrying on, FIG. 27 illustrates a top cross-sectional view of part of golf club head 27000 with a coupler restrictor mechanism. In the present example, golf club head 27000 is similar to golf club head 15000 (FIGS. 15-16), but comprises restrictor mechanism 27200 with restrictor 1210. Restrictor 1210 in the present embodiment comprises restrictor coupler 27212, where the stiffness of restrictor 1210 is greater than the stiffness of restrictor coupler 27212. In addition, weight end 1310 is coupled to restrictor coupler 27212. In the same or a different example, weight end 1310 can be attached or connected to restrictor coupler 27212 via bonding, gluing, welding, soldering, or other similar techniques. The stiffness of restrictor coupler 27212 is configured to permit deformation of restrictor coupler 27212 by weight end 1310 in response to impact at at least one of zones 1111-1112 of body 1100 of golf club head 27000.

In the present embodiment, restrictor mechanism 27200 further comprises restrictor 27220 opposite restrictor 1210. Weight end 1310 is between restrictor 27220 and restrictor coupler 27212. A stiffness of restrictor 27220 is greater than the stiffness of restrictor coupler 27212. Here, the stiffness of restrictor 27220 is configured to resist a deformation of restrictor 27220 by weight end 1310 in response to impact at zone 1112 of body 1100 of golf club head 27000. In a different embodiment, restrictor mechanism 27200 could comprise only restrictor 1210 with restrictor coupler 27212 while foregoing restrictor 27220. In such an embodiment, the reaction of golf club 27220 upon impact at zones 1111 and 1112 can be different from as described above for the present example of FIG. 27.

Figure 28:
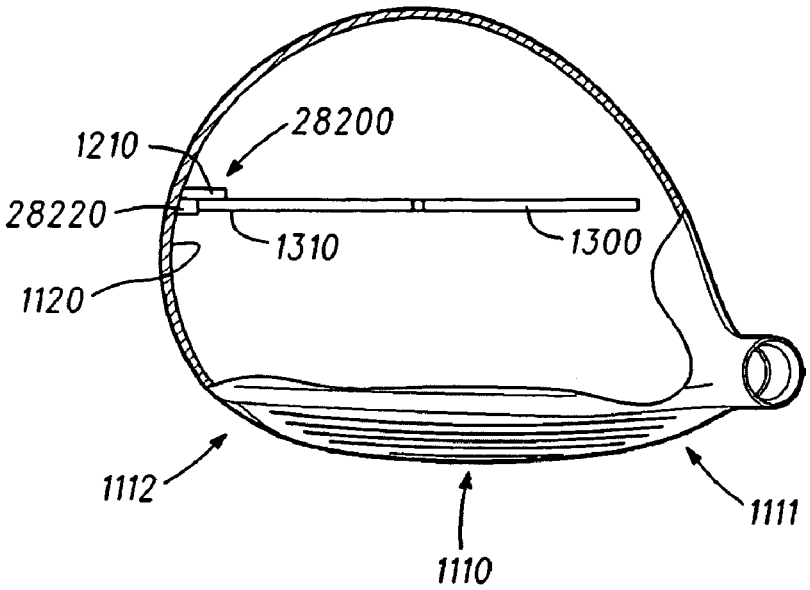
FIG. 28 illustrates a top cross-sectional view of part of a golf club head with a weight-edge restrictor mechanism.

Moving forward, FIG. 28 presents a top cross-sectional view of part of golf club head 28000 with an in-line restrictor mechanism. Golf club head 28000 is similar to golf club head 1000 (FIGS. 1-2), but comprises restrictor mechanism 28200 with restrictor 28220 instead of restrictor mechanism 1200 with only restrictor 1210.

Restrictor 28220 is between body portion 1120 and weight end 1310, and is substantially adjacent to restrictor 1210. In the present embodiment, the stiffness of restrictor 1210 is greater than the stiffness of restrictor 28220. The stiffness of restrictor 28220 is configured to permit a deformation of restrictor 28220 by weight end 1310 in response to impact at zone 1112 of body 1100 of golf club head 28000. In the present example, restrictor 1210 will resist deformation while interacting with weight end 1310 in response to impact at zone 1111, thus transferring the moment of inertia of weight 1300 to body 1100 to counteract the counterclockwise rotation of golf club head 28000. In contrast, restrictor 28220 can deform while interacting with weight end 1310 in response to an impact at zone 1112, limiting the moment of inertia of weight 1300 transferred to body 1100, and thus decreasing or negating the effect of weight 1300 upon the clockwise rotation of golf club head 28000.

Figure 29:
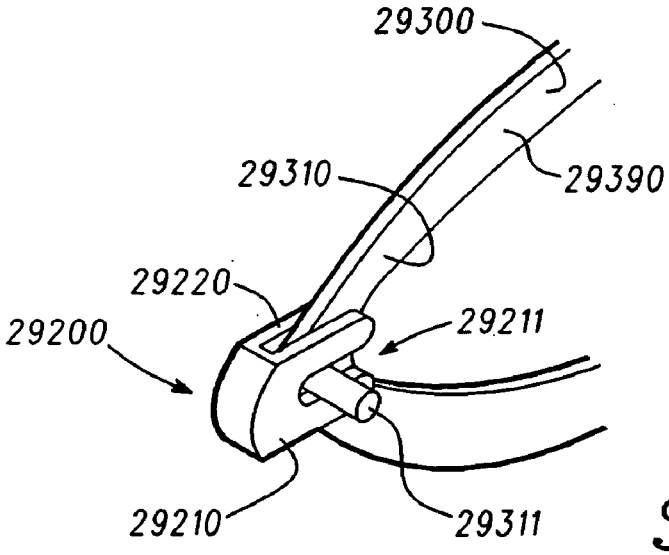
FIG. 29 illustrates a perspective view of a restrictor mechanism comprising a notched restrictor.

Continuing with the figures, FIG. 29 shows a perspective view of restrictor mechanism 29200 comprising a notched restrictor. Restrictor mechanism 29200 can be similar to restrictor mechanism 15200 of golf club head 15000 (FIGS. 15-16), but differs by comprising restrictor 29210 with notch 29211. Weight end 29310 of weight 29300 comprises protrusion 29311 coupled with notch 29211 of restrictor 29210. In the present embodiment, restrictor mechanism 29200 also comprises restrictor 29220. In the same or a different embodiment, restrictors 29210 and 29220 can comprise different stiffnesses. In some embodiments, weight end 29310 can further comprise a protrusion similar to protrusion 29311 coupled with a notch on restrictor 29220 similar to notch 29211. Notch 29211 of restrictor 29210 is configured to restrict weight 29300 from rotating along a plane substantially parallel to face 29390 when protrusion 29311 is coupled to notch 29211. In some embodiments, restrictor mechanisms similar to restrictor mechanism 29200, and corresponding protrusions similar to protrusion 29311, can be coupled to one or more portions of a golf club head, such as to portions 1120, 1130, 1140, 1150, and 1160 shown in FIGS. 24-25.

In some embodiments of the present invention, one or more restrictor mechanisms can be adjustable relative a corresponding weight end. For example, in FIGS. 15-16, restrictor mechanism 15200 can be adjustable relative to weight end 1310. In one embodiment, restrictor mechanism 15200 can be adjusted by substituting restrictors 1210 and/or 15220 with other restrictors having different properties. In the same or a different embodiment, restrictor mechanism 15200 could be adjusted by swapping the locations of restrictors 1210 and 15220. In such an embodiment, restrictor 1210 is adjustable from a position on side 1311 to side 1312 of weight end 1310. In the same of a different embodiment, restrictors 1210 and 15220 can be swapped by removing restrictor 15200 from body 1100 and reinstalling it at a 180-degree offset. In the same or a different embodiment, the adjustment can comprise removing restrictor mechanism 15200 from body 1100 and replacing with a different restrictor mechanism.

Figure 30:
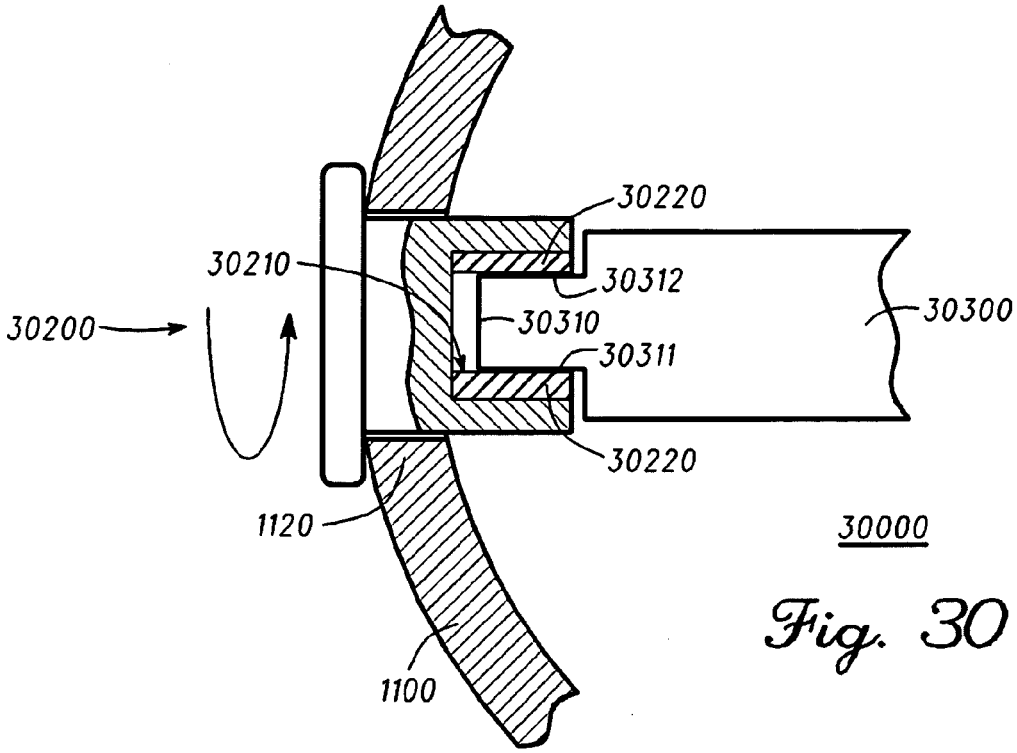
FIG. 30 illustrates a top cross-sectional view of a portion of a golf club head comprising an adjustable restrictor mechanism.

Continuing with the figures, FIG. 30 shows a top cross-sectional view of a portion of golf club head 30000 comprising an adjustable restrictor mechanism. Golf club head 30000 can be similar to any of the golf club heads described above, but comprises restrictor mechanism 30200 instead. In the same or a different embodiment, one or more restrictor mechanisms similar to restrictor mechanism 30200 could be positioned in lieu of one or more of the restrictor mechanisms described above at different body portions of corresponding body 1100, such as at body portions 1120, 1130, 1140, 1150, and/or 1160 (FIGS. 24 and 25).

In the present embodiment, restrictor mechanism 30200 comprises a restrictor cap with inner perimeter 30210 and restrictors 30220 along inner perimeter 30210. Golf club head 30000 also comprises weight 30300, which can be similar to one or more of the weights described earlier. Weight end 30310 of weight 30300 is configured to be coupled within inner perimeter 30210, between restrictors 30220.

In the embodiment of FIG. 30, the positions of restrictors 30220 relative to weight end 30310 are adjustable when the restrictor cap of restrictor mechanism 30220 is rotated relative to weight end 30310. In one example, restrictors 30220 can comprise restrictors comprising different stiffnesses. A pair of restrictors can be initially coupled to sides 30311-30312, respectively, of weight end 30310. After adjustment of restrictor mechanism 30220, a different pair of restrictors can be coupled to sides 30311-30312, respectively, of weight end 30310. After further adjustment of restrictor mechanism 30220, another pair of restrictors can be coupled to sides 30311-30312, respectively, of weight end 30310. Restrictor mechanism 30200 can thus allow for rearrangement of different stiffnesses to which weight end 30310 can be subjected to upon impact at certain zones of body 1100, including zones like zones 1111 and/or 1112 (FIGS. 1-2).

Figure 32:
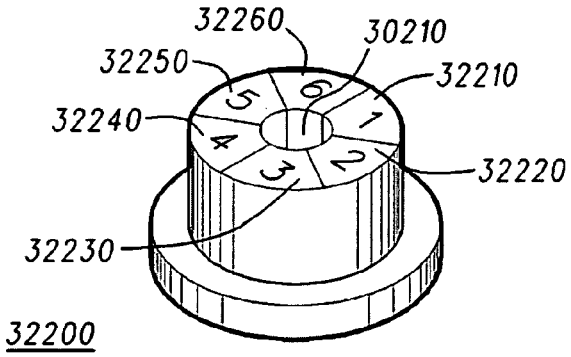
FIG. 32 illustrates a perspective view of another restrictor cap of the restrictor mechanism of FIG. 30.
Figure 31:
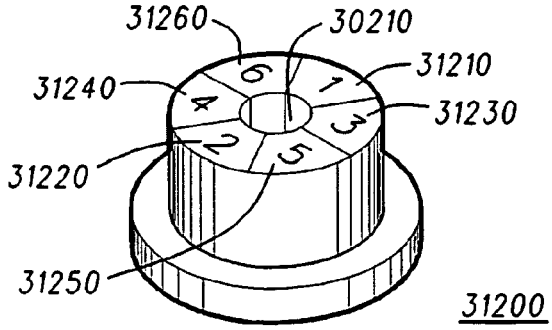
FIG. 31 illustrates a perspective view of a restrictor cap of the restrictor mechanism of FIG. 30.

Continuing with the figures, FIG. 31 shows a perspective view of restrictor cap 31200 of restrictor mechanism 30200. FIG. 32 shows a perspective view of restrictor cap 32200 of restrictor mechanism 30200. In some embodiments, restrictor caps 31200 and 32200 can be removable and/or interchangeable for restrictor mechanism 30200.

Restrictor cap 31200 comprises restrictors 31210, 31220, 31230, 31240, 31250, and 31260, which can be similar to the restrictors from the description of FIG. 30, but comprising inversely proportional stiffnesses. In the present example, a stiffness of restrictor 31210 is greater than a stiffness of restrictor 31230, and the stiffness or restrictor 13230 is greater than a stiffness of restrictor 13250. Similarly, a stiffness of restrictor 13220 is more flexible than a stiffness of restrictor 31240, and the stiffness of restrictor 31240 is more flexible than a stiffness of restrictor 31260. Therefore, the stiffness of restrictor 31210 is inversely proportional to the stiffness of restrictor 31220 because restrictor 31210 is stiffest while restrictor 31220 is most flexible amongst restrictors 31210, 31220, 31230, 31240, 31250, and 31260. Similarly, the stiffness of restrictor 31230 is inversely proportional to the stiffness of restrictor 31240 because restrictor 31230 is the second stiffest while restrictor 31240 is the second most flexible amongst restrictors 31210, 31220, 31230, 31240, 31250, and 31260. Finally, the stiffness of restrictor 31250 is inversely proportional to the stiffness of restrictor 31260 because restrictor 31250 is the third stiffest while restrictor 31260 is the third most flexible amongst restrictors 31210, 31220, 31230, 31240, 31250, and 31260.

Other embodiments can comprise a higher or lower number of restrictors similarly paired along inner perimeter 30210. As shown in FIG. 31, restrictors 31210 and 31220, 31230 and 31240, and 31250 and 31260 are positioned opposite each other along inner perimeter 30210 of restrictor cap 31200 based on their inversely proportional stiffnesses.

Restrictor cap 32200 comprises restrictors 32210, 32220, 32230, 32240, 32250, and 32260, which also can be similar to the restrictors from the description of FIG. 30, but comprising increasing stiffnesses. In the present example, a stiffness of restrictor 32210 is greater than a stiffness of restrictor 32220, which is greater than a stiffness of restrictor 32230, which is greater than a stiffness of restrictor 32240, which is greater than a stiffness of restrictor 32250, which is greater than a stiffness of restrictor 32260. As shown in FIG. 32, restrictors 32210, 32220, 32230, 32240, 32250, and 32260 are positioned alongside each other along inner perimeter 30210 of restrictor cap 32200 based on their increasing stiffnesses.

Figure 36:
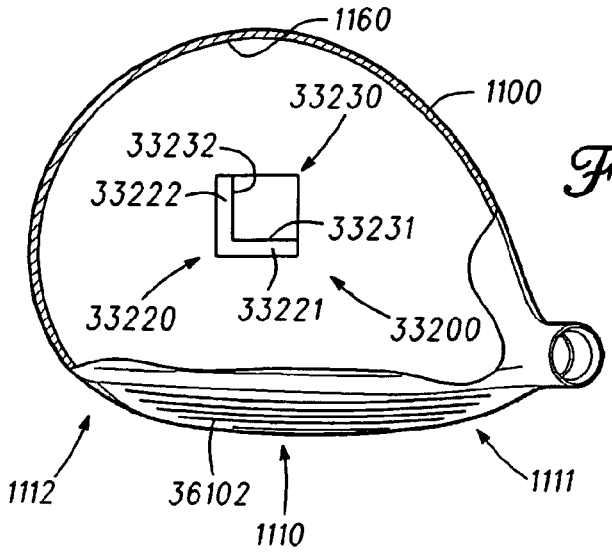
FIG. 36 illustrates a top cross-sectional view of part of the golf club head of FIG. 33.
Figure 37:
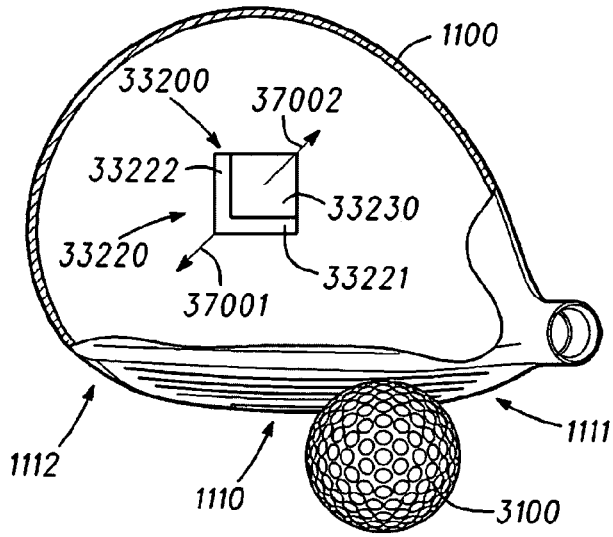
FIG. 37 illustrates a top cross-sectional view of part of the golf club head of FIG. 33 interacting with the golf ball at a heel portion.
Figure 38:
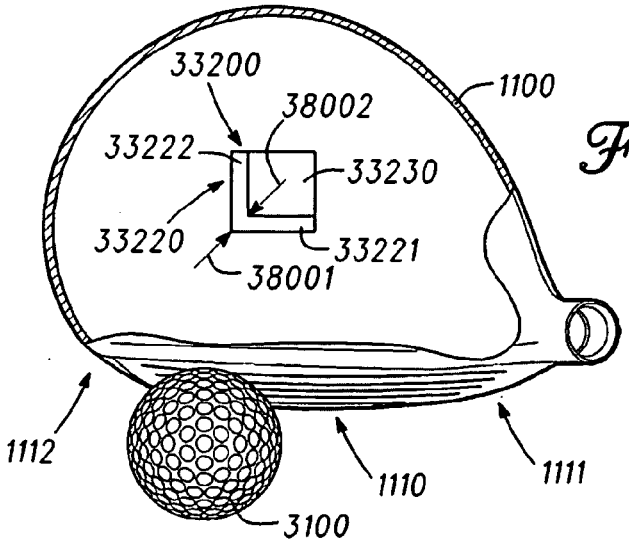
FIG. 38 illustrates a top cross-sectional view of part of the golf club head of FIG. 33 interacting with the golf ball at a toe portion.

Moving on with the figures, FIG. 33 illustrates a perspective cross-sectional view of part of golf club head 33000, comprising restrictor mechanism 33200. FIG. 34 shows a perspective cross-sectional view of part of golf club head 33000, focusing on weight 33230 of restrictor mechanism 33200. FIG. 35 shows a perspective cross-sectional view of part of golf club head 33000, focusing on tab set 33220 of restrictor mechanism 33200. FIG. 36 illustrates a top cross-sectional view of part of golf club head 33000. FIG. 37 illustrates a top cross-sectional view of part of golf club head 33000 interacting with ball 3100 at zone 1111. FIG. 38 illustrates a top cross-sectional view of part of golf club head 33000 interacting with ball 3100 at zone 1112.

Golf club head 33000 is similar to golf club head 1000, where restrictor mechanism 33200 can affect a rotation of golf club head 33000 via similar variable moment of inertia principles as described above for restrictor mechanism 1200 and weight 1300, respectively, of golf club head 1000 (FIGS. 1-4).

The embodiment of FIGS. 33-38 shows restrictor mechanism 33200 coupled to body 1100, with weight 33230 proximate to contiguous tabs 33221 and 33222 of tab set 33220. In the same or a different embodiment, body 1100 of golf club head 33000 can comprise face 36102 (FIG. 36) and housing 33101, where tab set 33220 and weight 33230 are coupled to a sole of housing 33101. Weight 33230 comprises side 33231 and 33232 adjacent to tabs 33221 and 33222, respectively. In a different embodiment, restrictor mechanism 33200 can comprise a single tab, adjacent to only one side of weight 33230. In another embodiment, restrictor mechanism 33200 can comprise more than two contiguous or non-contiguous tabs, adjacent to a corresponding number of sides of weight 33230. The present example of FIGS. 33-38 shows tab 33221 substantially parallel to front portion 1110 of body 1100, where tab 33222 is lateral and substantially perpendicular to tab 33221 to form an "L" shape corresponding to an outer surface of weight 33230. Other geometric configurations for restrictor mechanism 33200, however, are possible in other embodiments.

In the present example, restrictor mechanism 33200 couples to body 1100 at body portion 1150, proximate to a sole of golf club head 33000. In addition, a center of gravity of golf club head 33000 is proximate to restrictor mechanism 33200. In other embodiments restrictor mechanism 33200, and/or other similar restrictor mechanisms, can couple to one or more of body portions 1120, 1130, 1140, and/or 1160. In the same or a different embodiment, the center of gravity of golf club head 33000 can shift according to the location of restrictor mechanism 33200. In some embodiments, restrictor mechanism 33200 can be adjustable, for example, by being repositionable, removable and/or interchangeable with a different restrictor mechanism.

In the present example, restrictor mechanism 33200 comprises deformable portion 33240 coupled to weight 33230. FIG. 34 shows deformable portion 33240 as a pedestal that couples weight 33230 to body 1100 proximate to tab set 33220, where the respective stiffnesses of weight 33230 and tab set 33220 can be greater than the stiffness of deformable portion 33240. In a the same or a different embodiment, restrictor mechanism 33200 can comprise a different deformable portion that could be coupled to, or be part of, one or more tabs of tab set 33220 or of a different tab set.

In some embodiments, deformable portion 33240 can comprise at least one of a silicon material, a polymer material, and a epoxy material. In the same or a different embodiment, weight 33230 can comprise a mass of approximately 20 to 40 grams. In the same or a different embodiment, weight 33230 can comprise approximately 10 to 20 percent of a mass of golf club head 33000.

As shown in FIG. 37, restrictor mechanism 33200 can be configured to permit deformation of deformable portion 33240, responsive to inertia of weight 33230, upon impact at zone 1111 of body 1100. Tab set 33220 tends to rotate away from weight 33230 in the direction of arrow 37001 and along with body 1100 as golf club head 33000 rotates counterclockwise in response to impact at zone 1111. As a result of the initial stationary inertia of weight 33230, deformable portion 33240 tends to deform in the direction of arrow 37002 such that tab set 33220 tends to not interact with weight 33230 in the present situation. Little or no inertia is thus transferred from weight 3330 via tab set 33220 to body 1100 to counteract the counterclockwise rotation of head 33000.

In the same or a different embodiment, as shown in FIG. 38, restrictor mechanism 33200 can be configured to resist deformation of deformable portion 33240, via one or more of tabs 33221-33222, upon impact at zone 1112 of body 1100. In the present embodiment, both tabs 33221-33222 are configured to resist deformation of deformable portion 33240 upon impact at zone 1112 of body 1110. Tab set 33220 tends to rotate in the direction of arrow 38001 towards weight 33230 and along with body 1100 as golf club head 33000 rotates clockwise in response to impact at zone 1112. Because of the initial stationary inertia of weight 33230, deformable portion 33240 tends to deform in the direction of arrow 38002 such that tab set 33220 tends to interact with weight 33230 in the present situation. As weight 33230 is pressed against tab set 33220, further deformation of deformable portion 33240 is resisted. As a result, inertia can be transferred from weight 3330 via tab set 33220 to body 1100 to counteract the clockwise rotation of head 33000.

Figure 39:
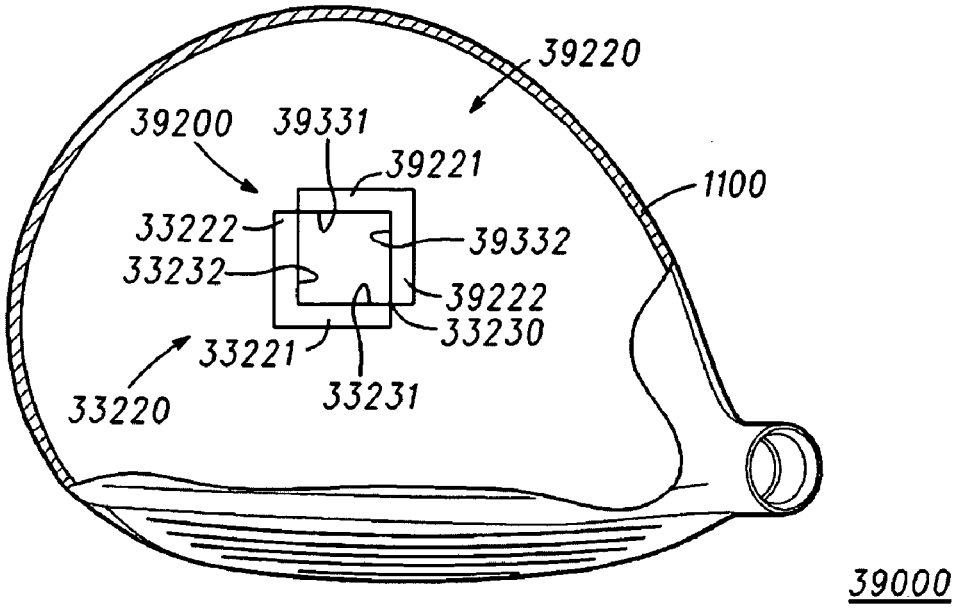
FIG. 39 illustrates a top cross-sectional view of part of a golf club head with a different restrictor mechanism.

Continuing with the figures, FIG. 39 shows a top cross-sectional view of part of golf club head 39000, comprising restrictor mechanism 39200. Golf club head 39000 is similar to golf club head 33000 (FIGS. 33-38), but differs in that restrictor mechanism 39200 comprises tab set 39220 in addition to tab set 33220. Tab set 39220 can couple to body 1100 in a manner similar to the manner described above for tab set 33220 (FIG. 33-35). In addition, tab set 39220 can couple to an outer surface of weight 33230 similar to as described above for tabs set 33220, where tabs 39221-39222 respectively couple to sides 39331-39332 of weight 33230.

In the present embodiment, tab set 33220 comprises a stiffness greater than a stiffness of tab set 39220. The stiffness of tab set 39220 can make tab set 39220 deformable, similar to the stiffness of deformable portion 33240 (FIGS. 33-38). In the same or a different embodiment, a deformable portion of restrictor mechanism 33200 (FIG. 33) can comprise or be part of restrictor mechanism 39200. In a different embodiment, the stiffnesses of tab sets 33220 and 39220 can be inverted. In a further embodiment, tab set 39220 can have the same stiffness as tab set 33220. In this further embodiment, the spacing between weight 33230 and tab set 39220 can be different than the spacing between weight 33230 and tab set 33220.

Figure 40:
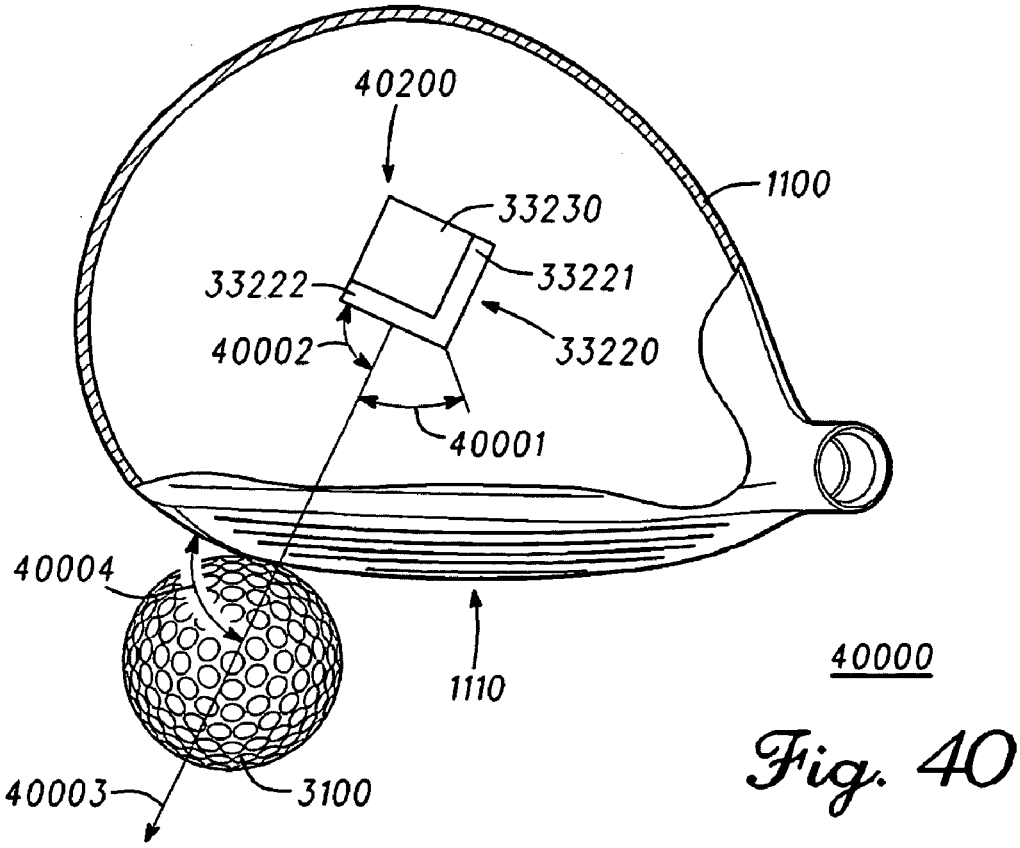
FIG. 40 illustrates a top cross-sectional view of part of a golf club head with an angled restrictor mechanism.

FIG. 40 illustrates a top cross-sectional view of part of golf club head 40000, comprising angled restrictor mechanism 40200. Golf club head 40000 is similar to golf club head 33000 (FIGS. 33-38), differing in that a tab of restrictor mechanism 40200 is not substantially parallel to front section 1110. Instead, at least a part of restrictor mechanism 40200 forms a non-perpendicular angle 40001 with front portion 1110.

In the present example, angle 40001 can be of approximately between 20 to 30 degrees. In the same or different embodiments angle 40001 can be configured to place one or more tabs of tab set 33220 at a desired angle 40002 relative to a predicted impact vector 40003. For example, impact vector 40003 can be determined based on a tendency to hit a golf ball with an open or closed golf club face. In the same or a different embodiment, angle 40001 of restrictor mechanism 40200 corresponds to angle 40004 of impact with body 1100. In the same or a different embodiment, angle 40001 can position a tab of tab set 33220 of restrictor mechanism 40200 relatively square with a point and direction of impact with ball 3100, even if front section 1110 is not square with the point and direction of impact.

Figure 41:
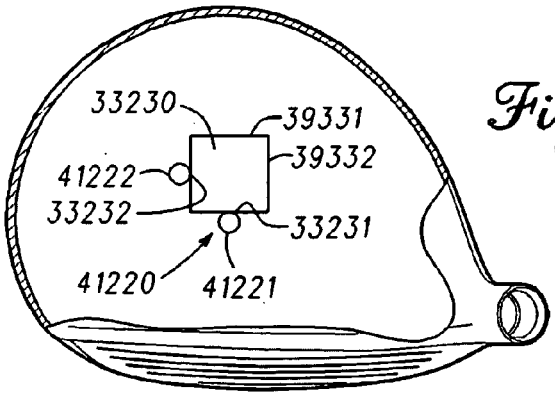
FIG. 41 illustrates a top cross-sectional view of part of a golf club head comprising a restrictor mechanism with one single-pole tab set.
Figure 42:
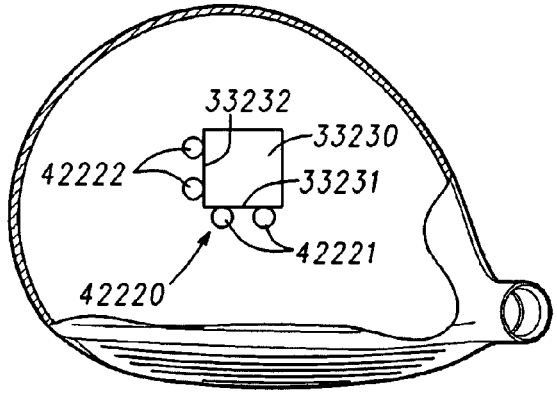
FIG. 42 illustrates a top cross-sectional view of part of a golf club head comprising a restrictor mechanism with one dual-pole tab set.
Figure 43:
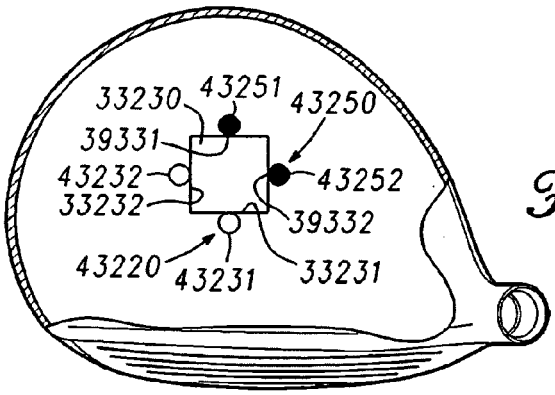
FIG. 43 illustrates a top cross-sectional view of part of a golf club head comprising a restrictor mechanism with two single-pole tab sets.
Figure 44:
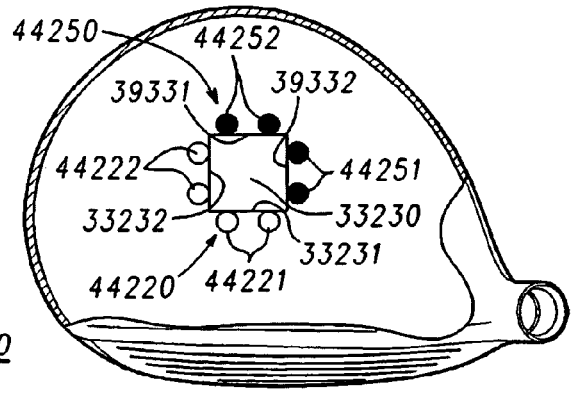
FIG. 44 illustrates a top cross-sectional view of part of a golf club head comprising a restrictor mechanism with two dual-pole tab sets.

Continuing with the figures, FIG. 41 shows a top cross-sectional view of part of golf club head 41000 comprising restrictor mechanism 41200 with one single-pole tab set. FIG. 42 shows a top cross-sectional view of part of golf club head 42000 comprising restrictor mechanism 42200 with one dual-pole tab set. FIG. 43 shows a top cross-sectional view of part of golf club head 43000 comprising restrictor mechanism 43200 with two single-pole tab sets. FIG. 44 shows a top cross-sectional view of part of golf club head 44000 comprising restrictor mechanism 44200 with two dual-pole tab sets. Golf club heads 41000, 42000, 43000, and 44000 are similar to golf club head 33000 (FIG. 33), but have different restrictor mechanisms.

In the embodiments of FIGS. 41-44, corresponding tab sets of restrictor mechanisms 41200, 42200, 43200, and 44200 comprise non-contiguous tabs or posts. More specifically, in FIG. 41, restrictor mechanism 41200 of golf club head 41000 comprises tab set 41220 with non-contiguous tabs or single posts 41221 and 41222 respectively coupled to sides 33231 and 33232 of weight 33230. In FIG. 42, restrictor mechanism 42200 of golf club head 42000 comprises tab set 42220 with non-contiguous tabs or dual posts 42221 and 42222 respectively coupled to sides 33231 and 33232 of weight 33230. The embodiment of FIG. 43 is similar to that of FIG. 41, but also comprises tab set 43250 with non-contiguous tabs or single posts 43251 and 43252 respectively coupled to sides 39331 and 39332 of weight 33230. The embodiment of FIG. 44 is similar to that of FIG. 42, but also comprises tab set 44250 with non-contiguous tabs or dual posts 44251 and 44252 respectively coupled to sides 39331 and 39332 of weight 33230.

The different posts described above for FIGS. 41-44 can have different respective stiffnesses to accordingly affect interaction with weight 33230 upon impact at different zones of body 1100. For example, for FIG. 44, a stiffness of tab set 44220 can be greater than a stiffness of tab set 44250, similar to as described above for tab sets 33220 and 39220 (FIG. 39). In the same or a different example, the spacing between weight 33230 and the different tab sets can be varied depending on the desired effect on the club head. For example, for FIG. 44, tab set 44250 can be positioned to permit a spacing between dual posts 44252 and side 39331, and/or between dual posts 44251 and side 39332.

Figure 45:
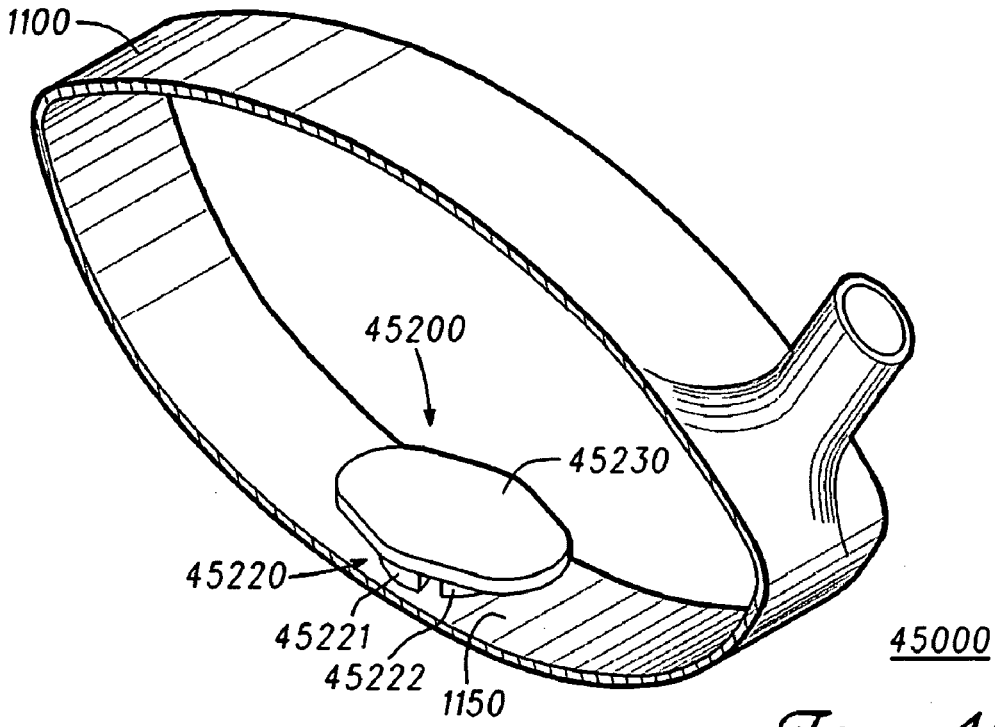
FIG. 45 illustrates a perspective cross-sectional view of part of a golf club head comprising a restrictor mechanism with a deformable base.
Figure 46:
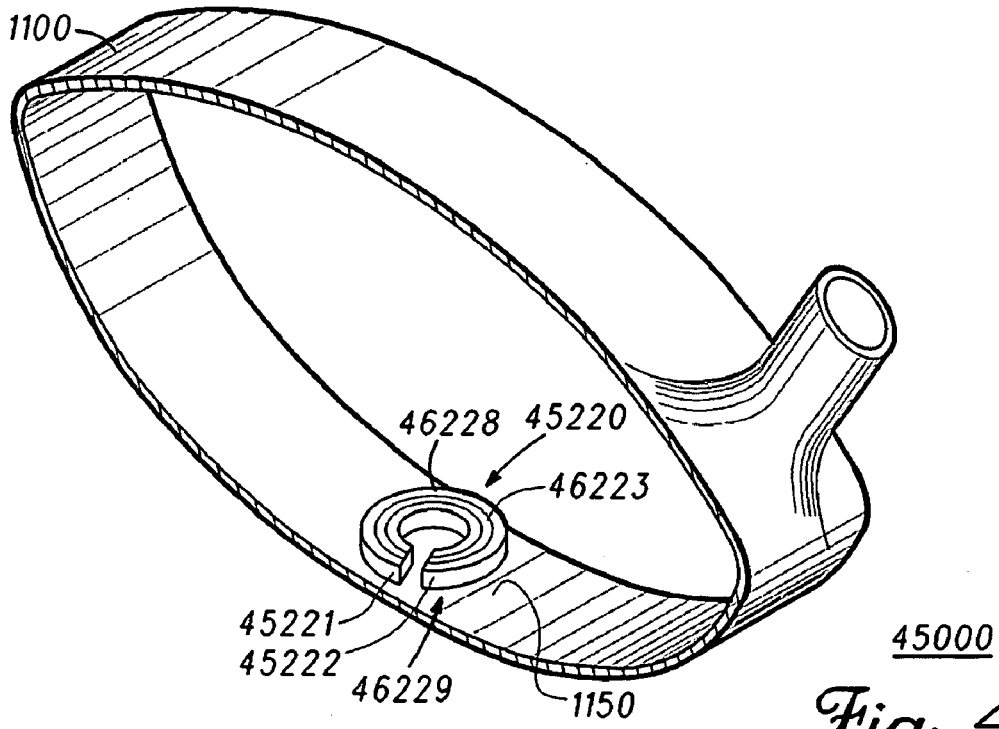
FIG. 46 illustrates another perspective cross-sectional view of part of the golf club head of FIG. 45, showing part of the restrictor mechanism of FIG. 45.
Figure 47:
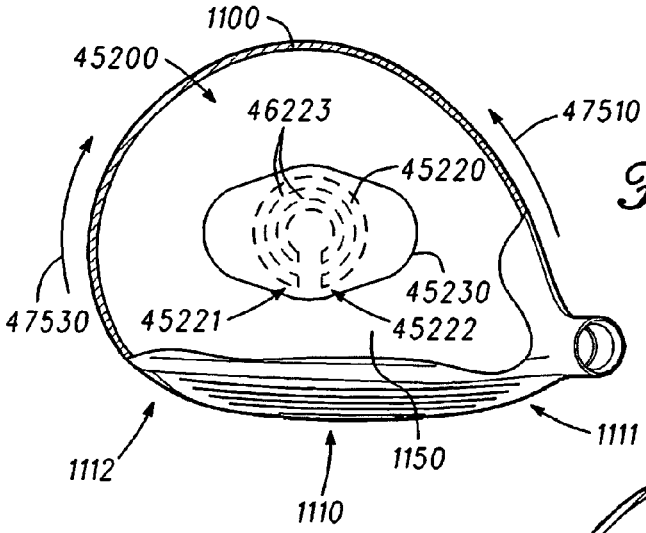
FIG. 47 illustrates a top cross-sectional view of part of the golf club head of FIG. 45.

Moving along, FIG. 45 illustrates a perspective cross-sectional view of part of golf club head 45000 comprising restrictor mechanism 45200 with a deformable base. FIG. 46 shows another perspective cross-sectional view of part of golf club head 45000, showing part of restrictor mechanism 45200. FIG. 47 shows a top cross-sectional view of part of golf club head 45000. Golf club head 45000 is similar to golf club head 1000 (FIG. 1), where restrictor mechanism 45200 can affect a rotation of golf club head 45000 via similar variable moment of inertia principles of as described above for restrictor mechanism 1200 and weight 1300, respectively, of golf club head 1000 (FIGS. 1-4).

In the embodiment of FIGS. 45-47, restrictor mechanism 45200 is coupled to portion 1150 of body 1100 and comprises both base 45220 and weight 45230. Base 45220 comprises opposite sides 46228 (FIG. 26) and 46229 (FIG. 46). Side 46229 is coupled to portion 1150 of body 1100 proximate to base end 45222. Side 46228 is coupled to weight 45230 proximate to base end 45221. In the present embodiment, base 45220 is ring-shaped, although other geometric configurations are possible. In the same or a different embodiment, the positioning or location of restrictor mechanism 45200 relative to body 1100 can be varied similar to as described above for restrictor mechanism 33200 (FIGS. 33-38) and the restrictor mechanisms in FIG. 24. Restrictor mechanism 45200 is configured to permit deformation of base 45220 in response to rotational inertia of weight 45230 relative to the rotation of golf club head 45000 in a first direction (i.e., a counterclockwise direction 47510 (FIG. 47)). In the same or a different embodiment, restrictor mechanism 45200 is configured to resist deformation of base 45220 in response to rotational inertia of weight 45230 relative to rotation of golf club head 45000 in a second direction (i.e., a clockwise direction 47530 (FIG. 47)).

In some embodiments, weight 45230 can comprise a mass of approximately 20 to 40 grams. In the same or a different embodiment, weight 45230 can comprise approximately 10 to 20 percent of a mass of golf club head 45000. In the same or a different embodiment, base 45220 can comprise a graphite material, among others.

In one example, base 45220 can deform by twisting to compress, and can resist deformation by resisting twisting to elongate and creating tension. In a different example, base 45220 can deform by twisting to elongate in response to tension, and can resist deformation by resisting twisting to compress.

In the example shown in FIG. 47, because weight 45230 is coupled proximate to base end 45221, while base end 45222 is fixed to section 1150 of body 1100, the inertia of weight 45230 may have a compressive effect on base 45220 when golf club head 45000 rotates counterclockwise along direction 47510. In addition, the inertia of weight 45230 can tend to have a tensile effect on base 45220 when golf club head 45000 rotates clockwise.

Correspondingly, in the present embodiment, base 45220 is configured to deform due to the inertia of weight 45230 compressing base 45220 when golf club head 45000 rotates in direction 47510 in response to impact at zone 1111. Base 45220 is also configured to resist tensile deformation induced by the rotational inertia of weight 45230 when golf club head 45000 rotates in direction 47530 in response to impact at zone 1112.

Because of the compressive deformation of base 45220 in this embodiment, less inertia from weight 45230 is transferred to body 1100 via base 45220 to counteract the counterclockwise rotation of golf club head 45000 in response to impact at zone 1111. In contrast, because of the resistance to tensile deformation of base 45220, more inertia from weight 45230 can be transferred to body 1100 via base 45220 to counteract the clockwise rotation of golf club head 45000 in response to impact at zone 1112. Other configurations for restrictor mechanism 45200, and corresponding effects, are possible in other embodiments.

In the present embodiment, base 45220 comprises an orthotropic material configured to deform in one direction and to resist deformation in another direction. In the same or a different embodiment, base 45220 can comprise one or more fiber strands 46223 extended from base end 45221 to base end 45222. In the same or a different embodiment, the fiber strands can be configured to permit compression of base 45220, and to resist tension of base 45220.

Figure 48:
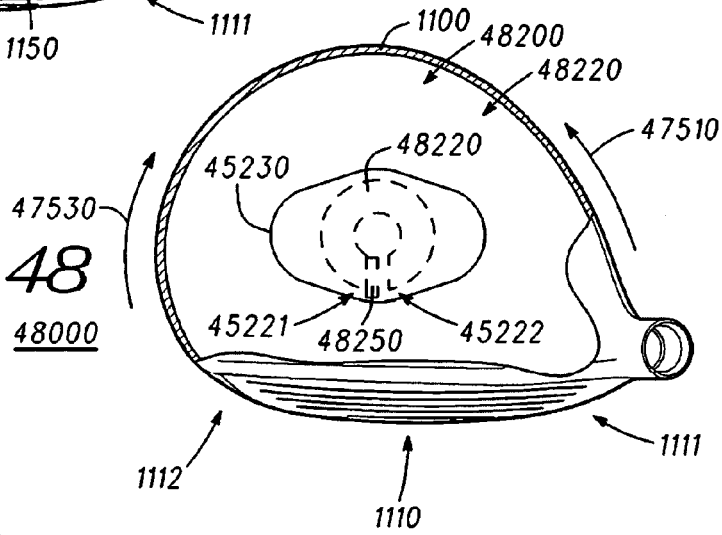
FIG. 48 illustrates a top cross-sectional view of part of a golf club head with another deformable-base restrictor mechanism.
Figure 49:
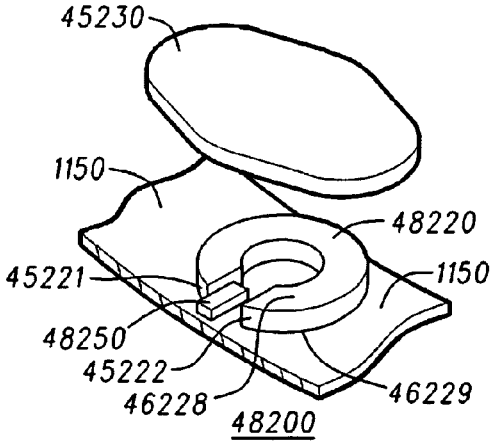
FIG. 49 illustrates a perspective exploded view of the restrictor mechanism of FIG. 48.

Continuing with the figures, FIG. 48 illustrates a top cross-sectional view of part of golf club head 48000 comprising restrictor mechanism 48200. FIG. 49 illustrates a perspective exploded view of restrictor mechanism 48200. Golf club head 48000 is similar to golf club head 45000 (FIGS. 45-47), but comprises restrictor mechanism 48200 with base 48220 and base detent 48250 instead. Base detent 48250 is coupled to body portion 1150 proximate to base end 45221. Base 48220 couples to body portion 1150 and to weight 45230 similar to the coupling described above for base 45220 (FIGS. 45-47).

In the present embodiment, base 48220 can comprise an isotropic material, capable of compressing and/or decompressing in different directions. For example, similar to the compression described above for base 45220 in FIG. 47, base 48220 can tend to compress in response to inertial effects from weight 45230 upon impact at zone 1111, and/or upon counterclockwise rotation of golf club head 48000 along direction 47510.

In contrast, being isotropic, base 48220 would normally tend to deform by elongating in response to inertial effects from weight 45230 upon impact at zone 1112 and/or upon clockwise rotation of golf club head 48000 along direction 47530. However, in the present example, base detent 48250 can restrict such elongation when base end 45221 is pressed against base detent 48250. In the present example, base detent 48250 is thus configured to restrict deformation of base 48220 in response to impact at portion 1112 of body 1100.

Figure 50:
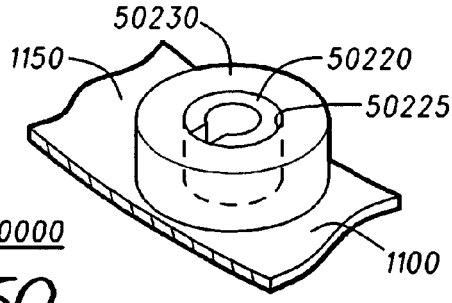
FIG. 50 illustrates a perspective view of part of a golf club head comprising a different deformable-base restrictor mechanism.

Carrying on, FIG. 50 illustrates a perspective view of part of golf club head 50000 comprising restrictor mechanism 50200 with a different deformable base. Restrictor mechanism 50200 is similar to restrictor mechanisms 45200 and 48200 of FIGS. 45-49, differing by comprising weight 50230 and base 50220 instead. Base 50220 can be similar to bases 45220 and 48220 (FIGS. 45-49), but comprises side surface 50225. Weight 50230 is configured to couple to side surface 50225 of base 50220. In the present embodiment, weight 50230 surrounds the entire perimeter of base 50220 along side surface 50225.

In some embodiments, one or more of restrictor mechanisms 45220, 48220, and/or 50220 (FIGS. 45-50) can be adjustable such as, for example, by being removable, interchangeable, and/or repositionable.

Figure 51:
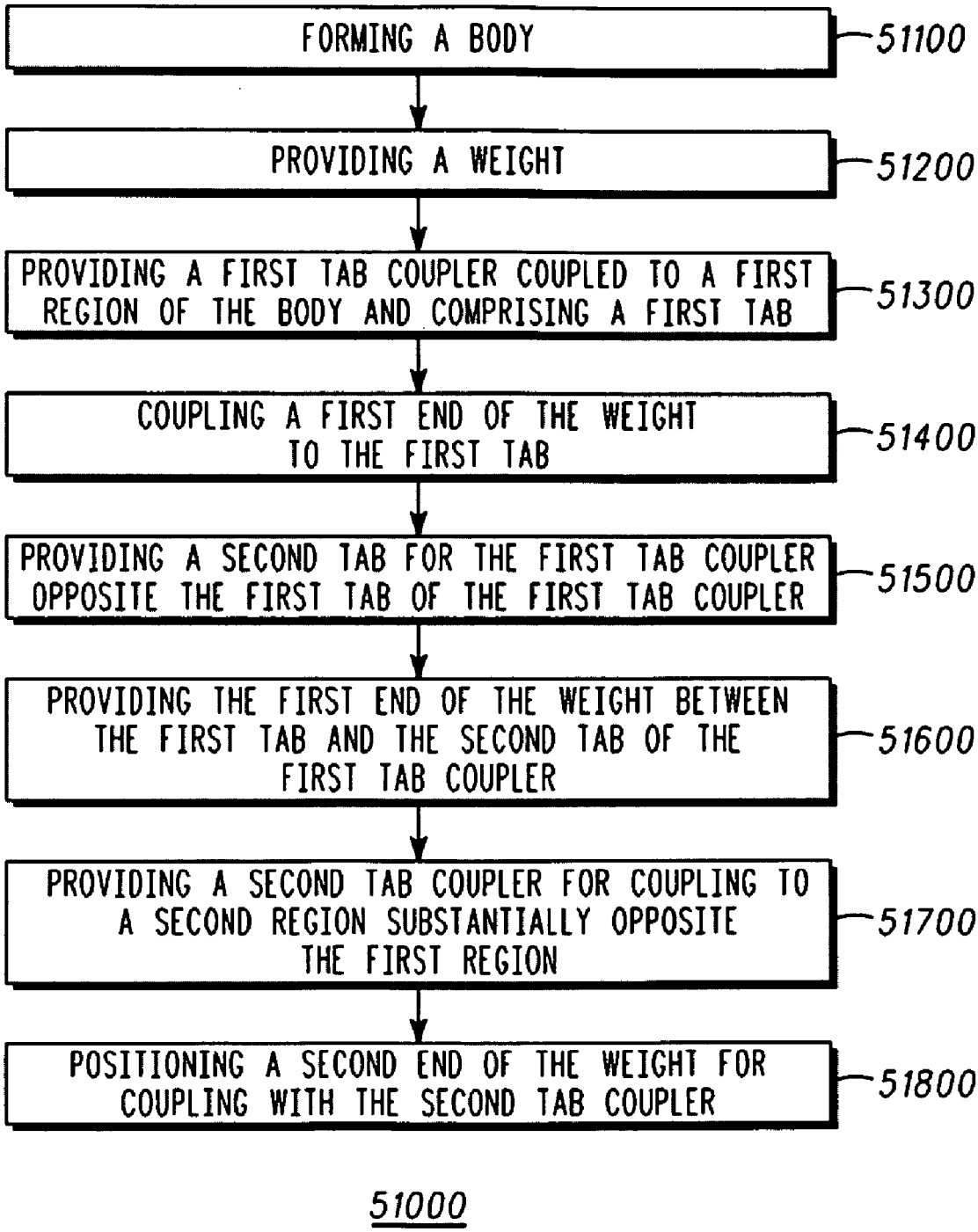
FIG. 51 illustrates a flowchart of a method for manufacturing a golf club head.

Moving along, FIG. 51 illustrates a flowchart of a method 51000 for manufacturing a golf club head. In some embodiments, the golf club head of method 51000 can be one of golf club heads 1000 (FIGS. 1-4), 5000 (FIGS. 5-6), 7000 (FIGS. 7-8), 9000 (FIGS. 9-10), 1100 (FIGS. 11-12), 13000 (FIGS. 13-14), 15000 (FIGS. 15-16), 17000 (FIG. 17), 18000 (FIGS. 18-19), 20000 (FIGS. 20-21), 22000 (FIG. 22), 23000 (FIG. 23), 24000 (FIGS. 24-25), 26000 (FIG. 26), 27000 (FIG. 27), 28000 (FIG. 28), and 30000 (FIG. 30) as described above. In some embodiments, the golf club head of method 51000 can be a driver-type head, a putter-type head, a wedge-type head, an iron-type head, a hybrid-type head, and/or a fairway wood-type head, among others.

Block 51100 of method 51000 comprises forming a body of the golf club head. In some embodiments, the body can be body 1100 as described above throughout FIGS. 1-30. In the same or a different embodiment, the body can be referred to as a housing or a shell. In the same or a different embodiment, the body can comprise a hosel and/or a bore capable of coupling with a golf club shaft.

Block 51200 of method 51000 comprises providing a weight. In some embodiments, the weight can be similar to weights 1300 (FIGS. 1-21, 27-28), 22300 (FIG. 22), 23300 (FIGS. 23 and 26), 24300 (FIGS. 24-25), and 30300 (FIG. 30), among others.

Block 51300 of method 51000 comprises providing a first tab coupler coupled to a first region of the body and comprising a first tab. In some embodiments, the first tab coupler can be one of restrictor mechanisms 1200 (FIGS. 1-4, 17), 5200 (FIGS. 5-6), 7200 (FIGS. 7-8), 9200 (FIGS. 9-10), 11200 (FIGS. 11-12), 13200 (FIGS. 13-14), 15200 (FIGS. 15-16, 18-21, 23-25), 17200 (FIGS. 17-19), 20200 (FIGS. 20-21, 23-25), 23200 (FIGS. 23-25), 23400 (FIGS. 23-25), 24200 (FIGS. 24-25), 27200 (FIG. 27), 28200 (FIG. 28), 29200 (FIG. 29), 30200 (FIG. 30), 31200 (FIG. 31), and/or 32200 (FIG. 32), among others. In the same or a different embodiment, the first tab can be, for example, similar to restrictors 1210 (FIGS. 1-4, 15-21, 23-25, 27-28), 29210 (FIG. 29), and

30210 (FIG. 30). The first portion of the body can be, for example, one of body portions 1120, 1130, 1140, 1150, and 1160 (FIGS. 1-2).

Block 51400 of method 51000 comprises coupling a first end of the weight to the first tab. In some examples, the first end of the weight can be one of weight ends 1310 (FIGS. 1-21, 24-25, 27-28), 1320 (FIGS. 1-2, 15-21, 23-25), 1330 (FIGS. 23-26), 1340 (FIGS. 23-26), 24350 (FIGS. 24-25), 29310 (FIG. 29), and/or 30310 (FIG. 30), among others. The first end of the weight can be coupled to the first tab by aligning the first end of the weight to be positioned adjacent to the first tab. In the same or different embodiment, the first end of the weight can also be coupled to the first tab by being attached to the first tab, as explained in more detail below.

In some examples, method 51000 can comprise block 51500. Block 51500 comprises providing a second tab for the first tab coupler opposite the first tab of the first tab coupler. In the same or a different embodiment, the second tab can be similar to restrictors 15220 (FIGS. 15-16, 18-25), 27220 (FIG. 27), 28220 (FIG. 28), 29220 (FIG. 29), and/or 30220 (FIG. 30). In one embodiment, blocks 51300 and 51500 are performed simultaneously with each other or in reverse order.

In examples where method 51000 comprises block 51500, method 51000 can comprise block 51600. Block 51600 comprises positioning the first end of the weight between the first tab and the second tab of the first tab coupler. In the same or a different example, the second tab can be configured to permit a greater distortion than the first tab. In one embodiment, blocks 51400 and 51600 can be performed simultaneously with each other.

For method 51000, the weight is configured to restrict or have a minimal effect upon a rotational tendency of the body of the golf club head upon an interaction between the first end of the weight and the first tab, which is responsive to an impact at a first portion of the body of the golf club head. In some embodiments, the first portion of the body can be a face or a front portion, such as for example zones 1111 and/or 1112 (FIGS. 1-21, 27-28). In the same or a different embodiment, the rotational tendency of the body can be restricted via principles similar to as described, for example, for FIGS. 3-14. In one embodiment, the rotational tendency can be clockwise. In a different embodiment, the rotational tendency can be counterclockwise.

In some examples of method 51000, the first end of the weight can be further connected to the first and/or second tab by bonding, welding, brazing, and/or gluing. In other embodiments, the first end of the weight can be coupled with the first and/or second tab by being aligned with the first tab coupler, even if there is no permanent connection to the first and/or second tab. In the same or different examples, the first tab coupler can be adapted to be adjustable relative to the first end of the weight such as, for example, by being removable, repositionable, replaceable, and/or interchangeable.

In some examples, method 51000 further comprises block 51700. Block 51700 comprises providing a second tab coupler for coupling to a second region of the body substantially opposite the first region of the body. The second tab coupler can be similar to the first tab coupler in block 51300.

In examples comprising block 51700, a block 51800 of method 51000 can comprise positioning a second end of the weight for coupling with the second tab coupler. Block 51800 can be carried out in a manner similar to the manner described for blocks 51300, 51400, and/or 51600 above for the first end of the weight with the first tab coupler. In the same or a different example, further tab couplers can be added to the body to couple with other ends of the weight.

In one embodiment, one or more of blocks 51100, 51200, 51300, 51400, 51500, 51600, 51700, and/or 51800 of method 51000 can be subparts of a single step. In the same or a different embodiment, the sequence of blocks 51100, 51200, 51300, 51400, 51500, 51600, 51700, and/or 51800 of method 51000 can be changed.

Figure 52:
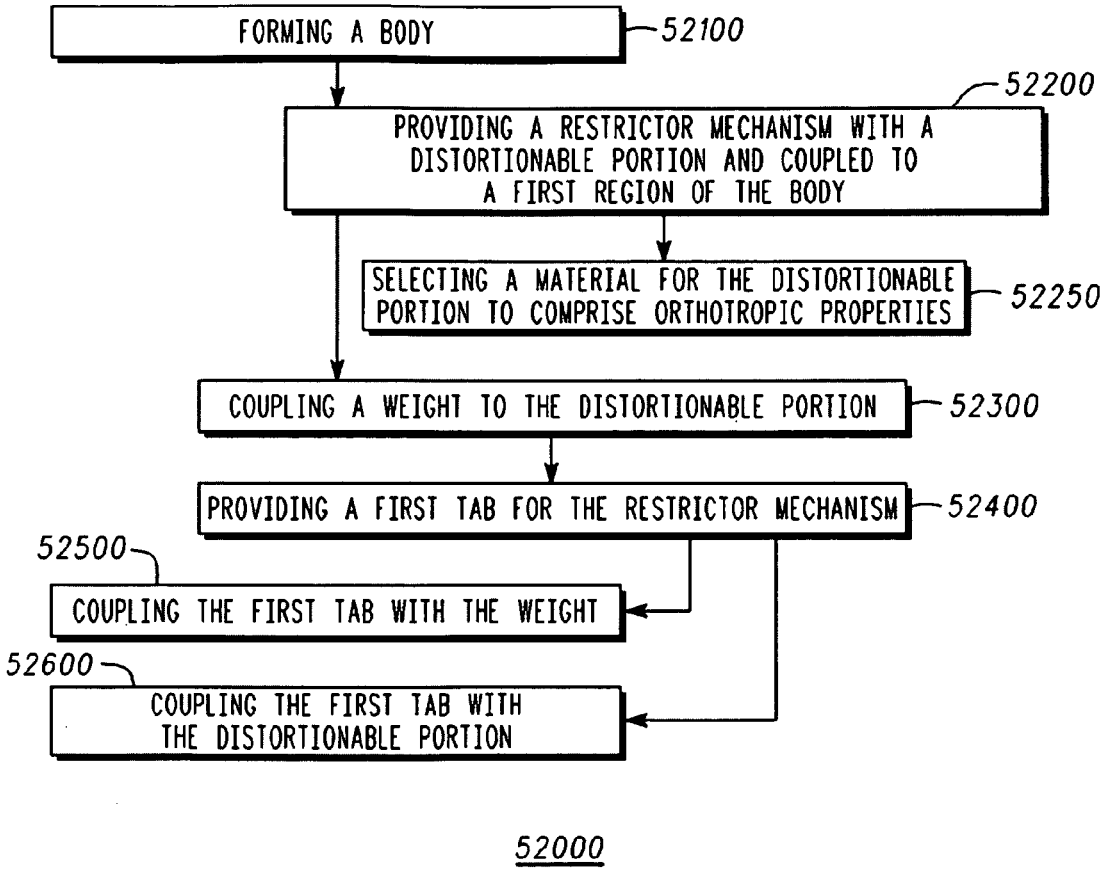
FIG. 52 illustrates a flowchart for another method for manufacturing a golf club head.

Progressing ahead, FIG. 52 illustrates a flowchart for a method 52000 for manufacturing a golf club head. In some embodiments, the golf club head of method 51000 can be one of golf club heads 33000 (FIGS. 33-38), 39000 (FIG. 39), 40000 (FIG. 40), 41000 (FIG. 41), 42000 (FIG. 42), 43000 (FIG. 43), 44000 (FIG. 44), 45000 (FIGS. 45-47), 48000 (FIGS. 48-49), and/or 50000 (FIG. 50). In some embodiments, the golf club head of method 52000 can be a driver head, a putter head, an iron head, a hybrid head, and/or a fairway wood head, among others.

Block 52100 of method 52000 comprises forming a body of the golf club head. In some embodiments, the body can be body 1100 as described above throughout FIGS. 33-50. In the same or a different embodiment, the body can be referred to as a housing or a shell. In the same or a different embodiment, the body can comprise a hosel and/or a bore capable of coupling with a golf club shaft.

Block 52200 of method 52000 comprises providing a restrictor mechanism with a distortable portion and coupled to a first region of the body. In some embodiments, the distortable portion can be similar to deformable portion 33240 (FIGS. 33-34), base 45220 (FIGS. 45-47), base 48220 (FIGS. 48-49), and base 50220 (FIG. 50).

In some examples, block 52200 of method 52000 can comprise sub-block 52500. Sub-block 52500 comprises selecting the distortable portion to comprise one or more orthotropic properties. In some examples, the distortable portion comprising orthotropic properties can be similar to base 45220 (FIGS. 45-47).

Block 52300 of method 52000 comprises coupling a weight to the distortable portion. In some embodiments, the weight can be similar to weights 33230 (FIGS. 33-34, 36-44), 45230 (FIGS. 45, 47-49), and/or 50230 (FIG. 50). In some embodiments, the weight can be coupled to the distortable portion in a manner similar to the manner described above in FIGS. 33-44 for weight 33230 and the pedestal of deformable portion 33240 (FIGS. 33-34). In a different embodiment, the weight can be coupled to the distortable portion similar to the manner described above in FIGS. 45-50 for weights 45230 and 50230 with bases 45220, 48220 and 50220.

In some examples, method 52000 can comprise block 52400. Block 52400 comprises providing a first tab for the restrictor mechanism. In some embodiments, the first tab can be similar to the tabs described in FIGS. 33-44 for tab sets 33220, 39220, 41220, 42220, 43220, 43250, 44220, and/or 44250, respectively. In a different embodiment, the first tab can be similar to the detent described in FIGS. 48-49 for base detent 48250.

In examples of method 52000 comprising block 52400, method 52000 can further comprise block 52500. Block 52500 comprises coupling the first tab with the weight. In some examples, the first tab can be coupled to the weight similar to the coupling described in FIGS. 33-44 for tab sets 33220, 39220, 41220, 42220, 43220, 43250, 44220, and/or 44250, respectively, with weight 33230.

In examples of method 52000 comprising block 52400, method 52000 can further comprise block 52600. Block 52600 comprises coupling the first tab with the distortable portion. Blocks 52500-52600 are not dependent upon each other, and either block can be carried out without carrying out the other. In some examples of block 52600, the first tab can be coupled with the distortable portion similar to the coupling described in FIGS. 48-49 for base detent 48250 and weight 45230.

In one embodiment, one or more of blocks 52100, 52200, 52250, 52300, 52400, 52500, and 52600 of method 52000 can be subparts of a single step. In the same or a different embodiment, the sequence of blocks 52100, 52200, 52250, 52300, 52400, 52500, and 52600 of method 52000 can be changed. In the same or a different embodiment, method 52000 can comprise further or different steps, such as a repetition of one or more of steps 52200, 52250, 52300, 52400, 52500, and/or 52600 for a second point of the body.

Although the golf club with variable moment of inertia and methods of manufacture thereof have been described with reference to specific embodiments, various changes may be made without departing from the spirit or scope of the golf club attachment mechanism and related methods. Various examples of such changes have been given in the foregoing description. As another example, the restrictor mechanisms illustrated herein are shown to be enclosed within a driver head, but a restrictor mechanism can be exposed or enclosed if incorporated into an iron head. Accordingly, the disclosure of embodiments of the golf club with variable moment of inertia and methods of manufacture thereof is intended to be illustrative of the scope of the application and is not intended to be limiting. It is intended that the scope of this application shall be limited only to the extent required by the appended claims. For example, it will be readily apparent that the golf club with variable moment of inertia and methods of manufacture thereof discussed herein may be implemented in a variety of embodiments, and that the foregoing discussion of certain of these embodiments does not necessarily represent a complete description of all possible embodiments. As a specific example, although FIGS. 24-25 show golf club head 24000 to comprise five restrictor mechanisms, other embodiments could be practiced comprising more than five restrictor mechanisms, and/or with restrictor mechanisms aligned and/or positioned differently, while still following the same concepts. Therefore, the detailed description of the drawings, and the drawings themselves, disclose at least one preferred embodiment of the golf club with variable moment of inertia and methods of manufacture thereof, and may disclose alternative embodiments of the golf club with variable moment of inertia and methods of manufacture thereof.

All elements claimed in any particular claim are essential to the golf club with variable moment of inertia and methods of manufacture thereof claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:
a body;
a face coupled to the body;
a restrictor mechanism coupled to the body, the restrictor mechanism comprising:
a weight; and
a deformable portion coupled to the weight and to a first portion of the body;
wherein:
the restrictor mechanism comprises:
a first resistance to a first deformation of the deformable portion in a first non-linear direction relative to the body; and
a second resistance to a second deformation of the deformable portion in a second non-linear direction relative to the body;
the first deformation is responsive to an inertia of the weight upon a first impact at a first one of a heel zone or a toe zone of the face;
the second deformation is responsive to the inertia of the weight upon a second impact at a different one of the heel zone or the toe zone of the face; and
the first resistance is greater than the second resistance.

2. The golf club head of claim 1, wherein:
the restrictor mechanism further comprises:
a first tab of one or more tabs, the first tab coupled to first portion of the body; and
the first tab and the weight are coupled proximate to each other.

3. The golf club head of claim 2, wherein:
the restrictor mechanism further comprises a second tab of the one or more tabs;
the second tab is lateral to the first tab;
the weight comprises a second side adjacent to the second tab; and
the second tab is configured to resist the deformation of the deformable portion in response to the impact at the second zone of the body.

4. The golf club head of claim 1, wherein:
the deformable portion comprises a pedestal; and
the pedestal couples the weight to the body.

5. The golf club head of claim 4, wherein:
a stiffness of the weight is greater than a stiffness of the pedestal.

6. The golf club head of claim 2, wherein:
the first tab is substantially parallel to a front of the body.

7. The golf club head of claim 6, wherein:
the restrictor mechanism further comprises a second tab of the one or more tabs;
the second tab is lateral to the first tab;
the weight comprises a second side adjacent to the second tab; and
the second tab is substantially perpendicular to the first tab.

8. The golf club head of claim 2, wherein:
the restrictor mechanism comprises an angle of approximately 20 to 30 degrees relative to a front of the body.

9. The golf club head of claim 2, wherein:
the restrictor mechanism comprises an angle corresponding to an angle of impact with the body relative to a front of the body.

10. The golf club head of claim 2, wherein:
the first tab is coupled to a sole of the body; and
the weight is coupled to the sole of the body.

11. The golf club head of claim 2, wherein:
the deformable portion comprises a second tab of the one or more tabs; and
the weight comprises a second side coupled to the second tab.

12. The golf club head of claim 11, wherein:
the second tab comprises a second stiffness; and the first tab comprises a first stiffness greater than the second stiffness.

13. The golf club head of claim 11, wherein:

the deformable portion comprises a third tab of the one or more tabs; and the weight comprises a third side coupled to the third tab.

14. The golf club head of claim 2, wherein:

at least one of the one of more tabs comprises one or more posts.

15. The golf club head of claim 1, further comprising:

a second restrictor mechanism coupled to a second portion of the body.

16. The golf club head of claim 1, wherein:

the restrictor mechanism is adjustable.

17. The golf club head of claim 1, wherein the weight comprises at least one of:

a mass of approximately 20 to 40 grams; or a mass of approximately 10 to 20 percent of a mass of the golf club head.

18. The golf club head of claim 1, wherein:

the body comprises at least one of:

a steel material, a titanium material, an aluminum material, or a graphite material;

the weight comprises at least one of:

a tungsten material, a tungsten-epoxy material, a steel material, a copper material, a titanium material, or a bronze material;

and the deformable portion comprises at least one of:

a silicon material; a polymer material; or an epoxy material.

19. The golf club head of claim 1, wherein:

the restrictor mechanism is configured to:

permit the first deformation; and resist the second deformation.

20. The golf club head of claim 1, wherein:

the deformable portion comprises:

a deformable base coupled between the weight and the first portion of the body.

21. The golf club head of claim 1, wherein:

the deformable portion of the restrictor mechanism is substantially non-responsive to an impact at a center of the face.

22. The golf club head of claim 1, wherein:

the first non-linear direction of the first deformation is one of clockwise or counterclockwise relative to the body; and the second non-linear direction of the second deformation is a different one of clockwise or counterclockwise relative to the body.

23. The golf club head of claim 1, wherein:

the first deformation of the deformable portion comprises one of:

a first compressive deformation in the first non-linear direction; or an first tensile deformation in the first non-linear direction;

when the first deformation comprises the first compressive deformation:

the second deformation of the deformable portion comprises a second tensile deformation in the second non-linear direction;

and when the first deformation comprises the first tensile deformation:

the second deformation of the deformable portion comprises a second compressive deformation in the second non-linear direction.

24. A golf club head, comprising:

a body; and a restrictor mechanism coupled to a first portion of the body, the restrictor mechanism comprising:

a base coupled to the first portion of the body; and a weight coupled to the base;

wherein:

the restrictor mechanism is configured to:

present a first resistance to a first deformation of the base in response to a rotational inertia of the weight relative to a rotation of the golf club head in a first direction; and present a second resistance to a second deformation of the base in response to the rotational inertia of the weight relative to a rotation of the golf club head in a second direction opposite the first direction;

and the first resistance is greater than the second resistance.

25. The golf club head of claim 24, wherein:

the base is configured to:

deform in response to the rotational inertia of the weight relative to the rotation of the golf club head in the first direction upon an impact at a first zone of a face of the body; and resist deformation in response to the rotational inertia of the weight relative to the rotation of the golf club head in the second direction upon an impact at a second zone opposite the first zone of the face of the body.

26. The golf club head of claim 24, wherein:

the base comprises at least one of:

an orthotropic material; or one or more fiber strands extended from a first end of the base to a second end of the base.

27. The golf club head of claim 24, wherein:

the restrictor mechanism further comprises a base detent coupled to the first portion of the body; and the base detent is configured to resist the deformation of the base in response to an impact at the first zone of the body.

28. The golf club head of claim 24, wherein:

the weight is coupled proximate to a first end of the base; and the first portion of the body is coupled proximate to a second end of the base.

29. The golf club head of claim 24, wherein:

the weight is coupled to a first surface of the base opposite the first portion of the body.

30. The golf club head of claim 24, wherein:

the weight is coupled to a side surface of the base.

31. The golf club head of claim 24, wherein:

the restrictor mechanism is adjustable.

32. The golf club head of claim 24, wherein:

the base is ring-shaped.

33. The golf club head of claim 24, wherein the weight comprises at least one of:

a mass of approximately 20 to 40 grams; or a mass of approximately 10 to 20 percent of a mass of the golf club head.

34. The golf club head of claim 24, wherein the base comprises a graphite material.

35. A method of manufacturing a golf club head, the method comprising:

forming a body;

providing a face coupled to the body;

providing a restrictor mechanism with a distortable portion and coupled to a first point of the body; and coupling a weight to the distortable portion;

wherein:

the restrictor mechanism is configured to:

provide a first resistance to a first distortion of the distortable portion in response to a rotational inertia of the weight upon impact at one of a toe zone of the face or a heel zone of the face; and provide a second resistance to a second distortion of the distortable portion in response to the rotational inertia of the weight upon impact at a different one of the toe zone or the heel zone;

the first distortion is in one of a clockwise direction or a counterclockwise direction relative to the body;

the second distortion is in a different one of the clockwise direction or the counterclockwise direction; and the first resistance is greater than the second resistance.

36. The method of claim 35, wherein:

providing the restrictor mechanism with the distortable portion further comprises:

selecting the distortable portion to comprise one or more orthotropic properties.

37. The method of claim 35, further comprising:

providing a first tab for the restrictor mechanism.

38. The method of claim 37, further comprising:

coupling the first tab with at least one of the weight or the distortable portion.

* * * * *